US006159293A

United States Patent [19]

Kolesnichenko et al.

[11] Patent Number: 6,159,293

[45] Date of Patent: Dec. 12, 2000

[54] MAGNETIC CONTAINMENT OF HOT DIP COATING BATH

[75] Inventors: Anatoly Kolesnichenko, Merrillville, Ind.; Volodimir Vodyanyuk, Toronto, Canada; James J. Deegan, Flossmoor, Ill.; William A. Carter, Munster; Philip G. Martin, Gary, both of Ind.

[73] Assignee: Inland Steel Company, Chicago, Ill.

[21] Appl. No.: 09/046,307

[22] Filed: Mar. 23, 1998

Related U.S. Application Data

[63] Continuation-in-part of application No. 08/964,428, Nov. 4, 1997, Pat. No. 6,037,011.

[51] Int. Cl.[7] ..... B05C 3/10; B05C 3/172; B05C 11/06

[52] U.S. Cl. ..... 118/623; 118/638; 118/63; 118/407; 118/419; 118/429

[58] Field of Search ..... 118/62, 63, 407, 118/419, 429, 620, 621, 422, 623, 638

[56] References Cited

U.S. PATENT DOCUMENTS

| | | | |
|---|---|---|---|
| 4,317,428 | 3/1982 | Sander et al. | 118/623 |
| 4,904,497 | 2/1990 | Lewis | 427/47 |
| 5,197,534 | 3/1993 | Gerber et al. | 164/467 |
| 5,665,437 | 9/1997 | Frommann et al. | 427/591 |
| 5,702,528 | 12/1997 | Paramanov et al. | 118/623 |
| 5,827,576 | 10/1998 | Carter et al. | 427/436 |
| 5,897,683 | 4/1999 | Unoki et al. | 75/10.14 |
| 5,897,756 | 4/1999 | Fuchs | 204/273 |
| 5,965,210 | 10/1999 | Tada et al. | 427/434.7 |

FOREIGN PATENT DOCUMENTS 2131059 9/1995 Canada .

OTHER PUBLICATIONS

Saucedo et al., "The Principle of 'Forbidden Zones' By MDH Containment Of Liquid Metals", Proceedings, Conference on Electromagnetic Processing of Materials, Paris, France, May 26–29, 1997.

*Primary Examiner*—Keith Hendricks
*Assistant Examiner*—Drew Becker
*Attorney, Agent, or Firm*—Marshall, O'Toole, Gerstein, Murray & Borun

[57] ABSTRACT

A hot dip coating system comprises a bath of molten coating metal contained in a vessel having a strip passage opening located below the top surface of the bath. A metal strip is directed along a path extending through the strip passage opening and through the bath of molten coating metal, to coat the strip. An electromagnet is employed to prevent the escape of the bulk of the molten coating metal from the bath through the strip passage opening while permitting the strip to move along its path. Expedients are provided to reduce leakage of molten coating metal through the strip passage opening.

27 Claims, 17 Drawing Sheets

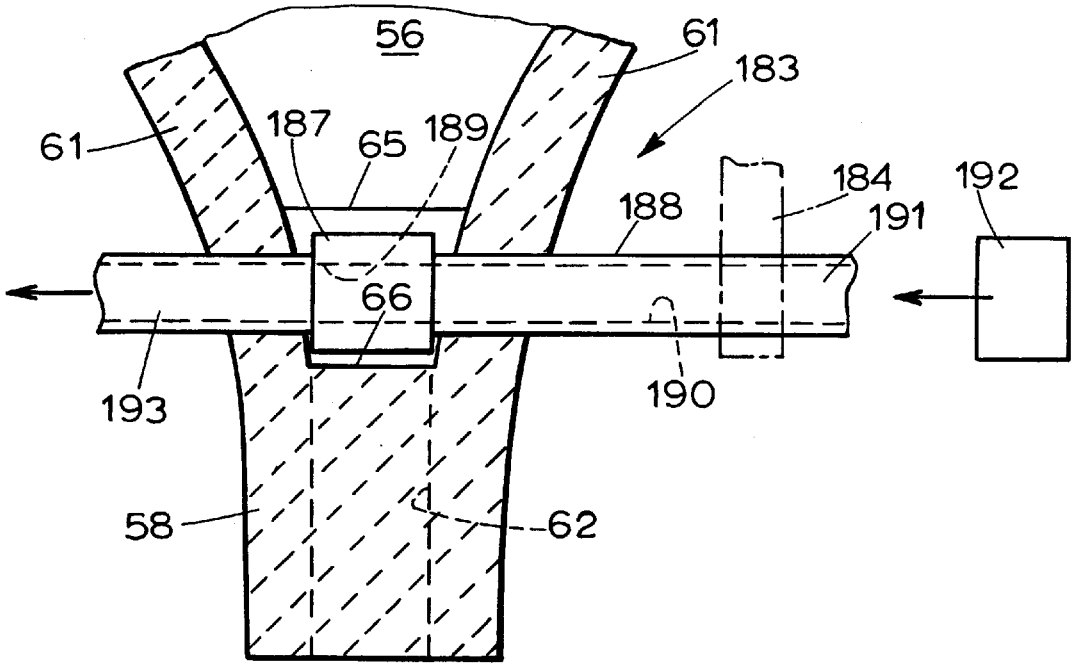
FIG. 18
FIG. 19
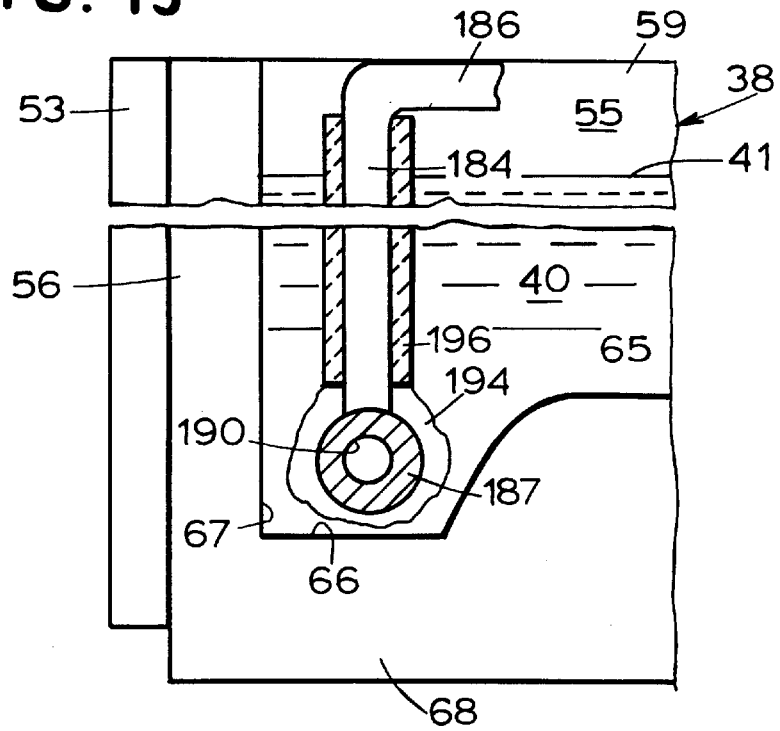

MAGNETIC CONTAINMENT OF HOT DIP COATING BATH

RELATED APPLICATION

This is a continuation-in-part of application Ser. No. 08/964,428 filed Nov. 4, 1997 now U.S. Pat. No. 6,037,011 entitled "Hot Dip Coating Employing A Plug Of Chilled Coating Metal", and the disclosure therein is incorporated herein by reference.

BACKGROUND OF THE INVENTION

The present invention relates generally to the hot dip coating of a metal strip, such as a steel strip, with a coating metal such as zinc or aluminum, and more particularly to a hot dip coating procedure which dispenses with the need for one or more strip guide rolls submerged below the surface of a bath of molten coating metal.

Steel strip is coated with a coating metal, such as zinc or aluminum, to improve the resistance of the steel strip to corrosion or oxidation. One procedure for coating steel strip is to dip the steel strip in a bath of molten coating metal. The conventional hot dip procedure is continuous and usually requires, as a preliminary processing step, pre-treating the steel strip before the strip is coated with a coating metal. Pre-treatment improves the adherence of the coating to the steel strip, and the pre-treating step can be either (a) a preliminary heating operation in a controlled atmosphere or (b) a fluxing operation in which the strip surface is conditioned with an inorganic flux.

Whatever the pre-treatment, the conventional hot dip coating procedure employs a coating step performed in a bath of molten coating metal containing one or more submerged guide rolls for changing the direction of the steel strip or otherwise guiding the strip as it undergoes the hot dip coating step. More particularly, the steel strip normally enters the bath of molten coating metal from above and moves in a direction having a substantially downward component, then passes around one or more submerged guide rolls that change the direction of the steel strip from substantially downward to substantially upward, following which the strip is withdrawn from the bath of molten coating metal as the strip moves in the upward direction.

A number of problems arise from the employment of guide rolls submerged in the bath of molten coating metal. These problems are described in detail in application Ser. No. 08/822,782 entitled "Hot Dip Coating Method And Apparatus", and the description therein is incorporated herein by reference.

Certain attempts have been made to eliminate the employment of submerged guide rolls in a hot dip coating procedure. In these attempts, the steel strip is introduced into the molten coating metal through an elongated strip passage opening in the vessel which contains the bath; the opening is typically located below the surface of the bath, and the strip is directed through the opening and through the bath along a substantially vertical, straight-line path. Conducting a strip through the bath along a straight-line path eliminates the need for submerged guide rolls to change the direction of the strip as it passes through the bath.

The elongated, strip passage opening is typically located in the bottom of the vessel containing the bath, and expedients are employed to prevent the molten metal in the bath from escaping through the strip passage opening.

Some expedients employ mechanical seals at the opening. These mechanical seals engage the side surfaces and edges of the strip as the strip moves upwardly through the opening, causing the seal to wear or break which in turn causes leakage of molten coating metal through the opening. Other problems associated with mechanical seals include freezing and large thermal gradients in the coating metal bath, and quality problems with the strip coating including irregularities in the coating thickness on the strip.

Other expedients employ electromagnetic devices that are located adjacent the strip passage opening and which develop electromagnetic forces which urge the molten metal in the bath away from the opening. These devices may prevent the escape, from the molten metal bath, of the bulk of the molten metal in the bath (bulk containment), but they still allow some leakage or dripping of molten metal from the bath through the strip passage opening, particularly at the side edges and at the ends of the elongated vessel opening. Leakage of this type can be a major problem.

SUMMARY OF THE INVENTION

The present invention is directed to a hot dip coating system which provides all the benefits accompanying the elimination of submerged guide rolls, and in addition, not only obtains bulk containment of the molten coating metal in the bath, but also substantially reduces the leakage or dripping of molten coating metal through the strip passage opening. The leakage reduced by the present system is leakage that is allowed by the electromagnetic devices described in the preceding paragraph. A system in accordance with the present invention includes one or more of the expedients described below.

The vessel containing the molten metal coating bath is trough-shaped with side walls converging downwardly toward the strip passage opening in the vessel bottom. The associated electromagnet has a pair of opposed, mutually facing pole faces, each adjacent a respective side wall of the vessel and each substantially following the contour of the adjacent sidewall. This increases the magnetic flux density generated by the electromagnet across the bottom of the vessel, in turn increasing the upwardly directed magnetic force which urges the bottom of the bath of molten coating metal away from the bottom opening in the vessel.

Operation of the electromagnet agitates the bath, and that agitation contributes to the leakage problem. In accordance with the present invention, a device is provided for mechanically damping the bath agitation produced by operation of the electromagnet. This damping device is in the form of a plurality of horizontally disposed, vertically spaced, pairs of planar members, defining a central slot through which the steel strip passes.

The planar members described in the preceding paragraph are composed of ferromagnetic material, and they define a low reluctance path for magnetic flux in the gap between the opposed, mutually facing pole faces. As such, the planar members reduce the effective gap between the mutually facing pole faces of the electromagnet, thereby increasing the magnetic flux density at the gap, in turn increasing the upwardly directed magnetic force at the bottom opening of the vessel. Gap-reducing, ferromagnetic planar members may be employed independently of the damping device described in the preceding paragraph.

There are guide elements which maintain the steel strip centered within the vessel. The guide elements counteract the tendency of the electromagnet to attract the strip toward one of the two opposed, mutually facing pole faces and restrain the side to side movement the steel strip would otherwise undergo as it moves through the vessel, a movement which is undesireable.

There is an electric current conductor having a pair of terminals each in direct contact with the molten coating bath at the bottom of the bath, and each located in a sump at a respective end of the strip passage opening. The current conductor conducts either (a) direct current from an outside source (when the electromagnet is energized by direct current), or (b) the eddy currents generated by the magnetic flux from the electromagnet (when the electromagnet is energized by a time-varying current). The electric currents described above flow between the terminals of the current conductor, at the bottom of the bath of molten coating metal. The electric currents cooperate with the magnetic flux from the electromagnet, at the bottom of the bath, to produce a magnetic force which urges the bottom of the bath upwardly away from the bottom opening in the vessel. Employing a current conductor concentrates the electric current at desired locations at the bottom of the bath, and substantially enhances the effectiveness of the upwardly directed magnetic force there, compared to the magnetic force produced in the absence of a current conductor.

In one embodiment, the coils for the electromagnet are part of a so-called series LCR electrical circuit. This circuit is operated in a manner which automatically increases the current for generating magnetic flux whenever there is a drop in the level of the bottom of the bath of molten metal adjacent the bottom opening in the vessel. This increases the magnetic force urging the bottom of the bath upwardly.

Other features and advantages are inherent in the method and apparatus claimed and disclosed or will become apparent to those skilled in the art from the following detailed description in conjunction with the accompanying diagrammatic drawings.

BRIEF DESCRIPTION OF THE DRAWINGS

FIG. 18 is an enlarged, fragmentary sectional view, taken transverse to the section shown in FIG. 17, and showing other portions of the current conductor;

FIG. 19 is a fragmentary interior view of a vessel-half showing another embodiment of a current conductor;

DETAILED DESCRIPTION

Figure 1:
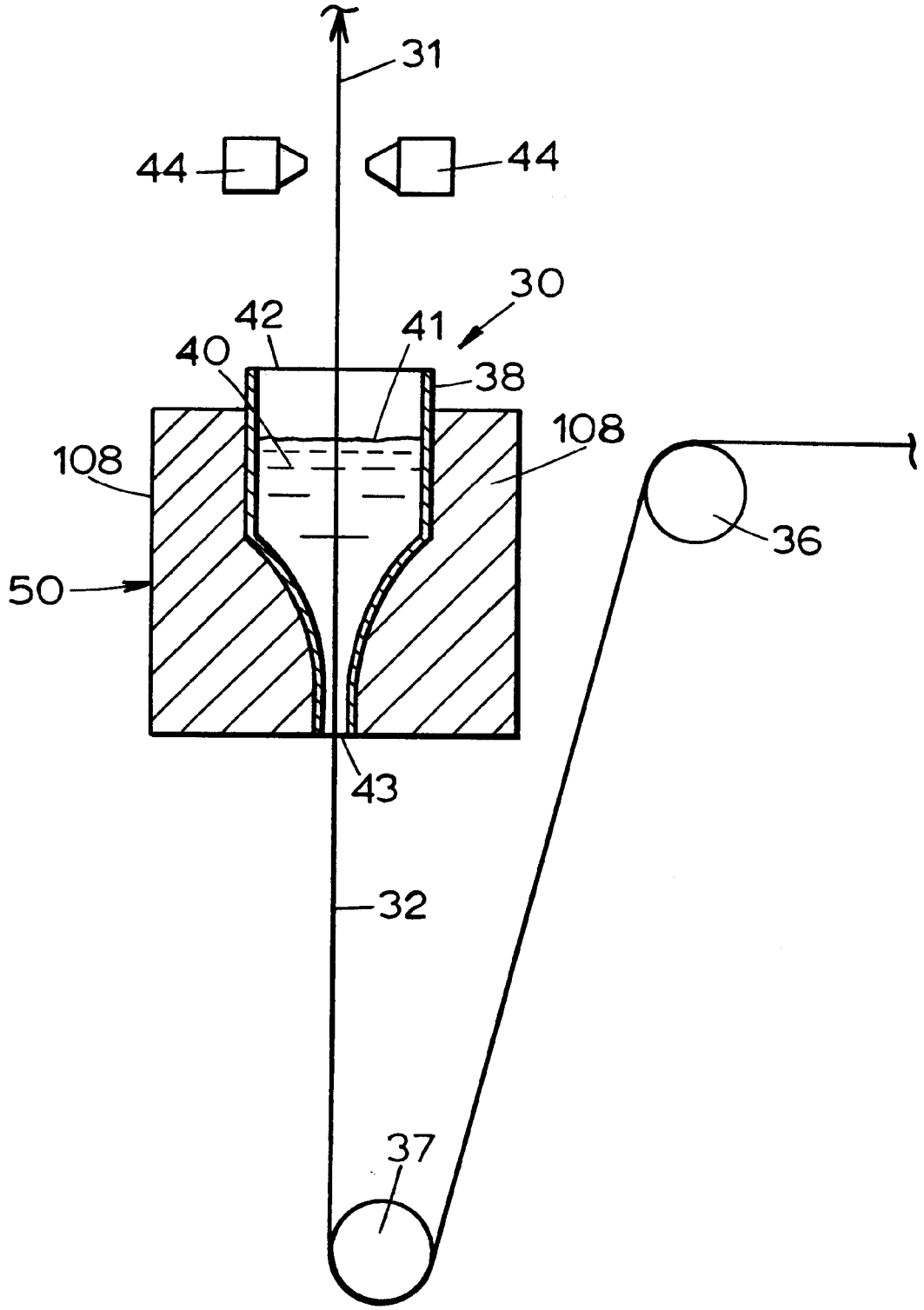
FIG. 1 is a schematic diagram, partially in section, of a hot dip coating system in accordance with one embodiment of the present invention.
Figure 2:
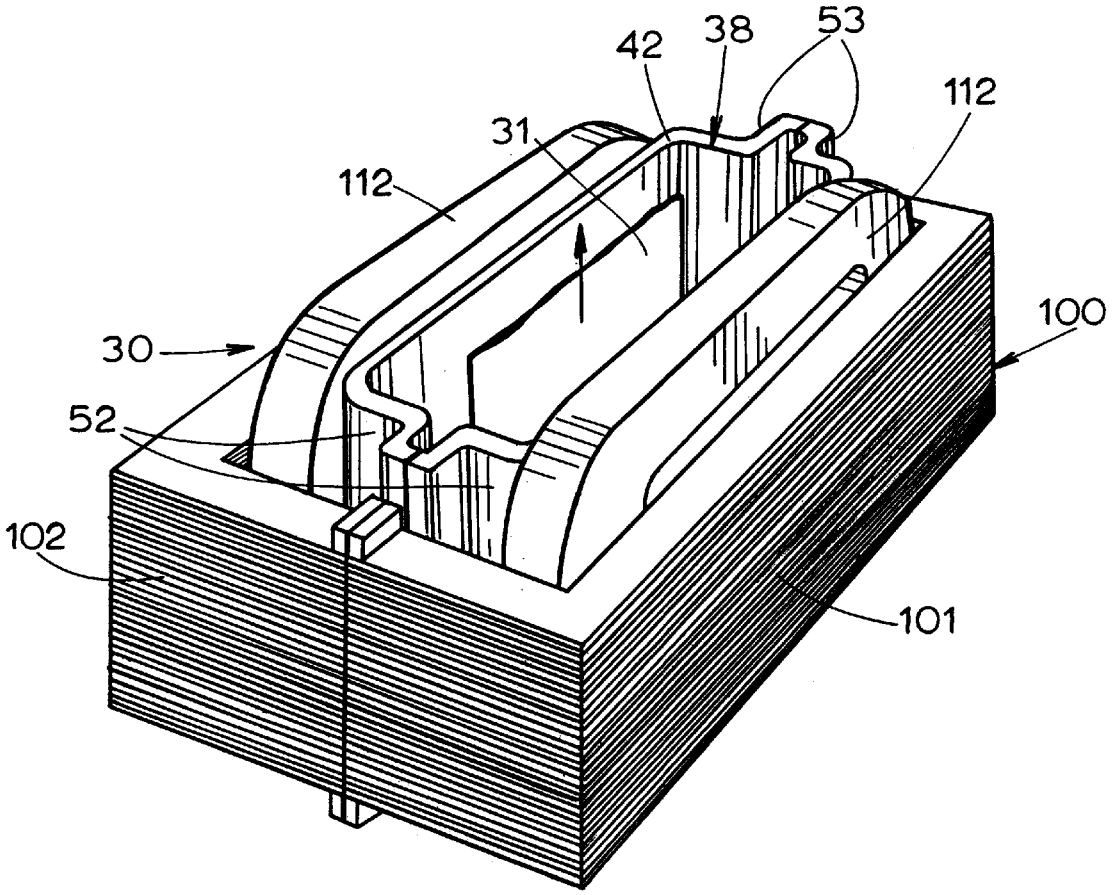
FIG. 2 is a perspective showing a vessel and an electromagnet employed in the system.

Referring initially to FIG. 1, illustrated generally at 30 is an embodiment of a hot dip coating system in accordance with the present invention. System 30 in FIG. 1 is intended for use in the coating of a continuous strip of metal, such as steel, with a coating metal composed of zinc or zinc alloy. Other embodiments of hot dip coating systems in accordance with the present invention may be employed to coat a continuous metal strip with other coating metals such as aluminum, aluminum alloys or the like. Tin, lead and alloys of each are typical examples of still other coating metals which may be applied in hot dip coating systems in accordance with other embodiments of the present invention.

Figure 3:
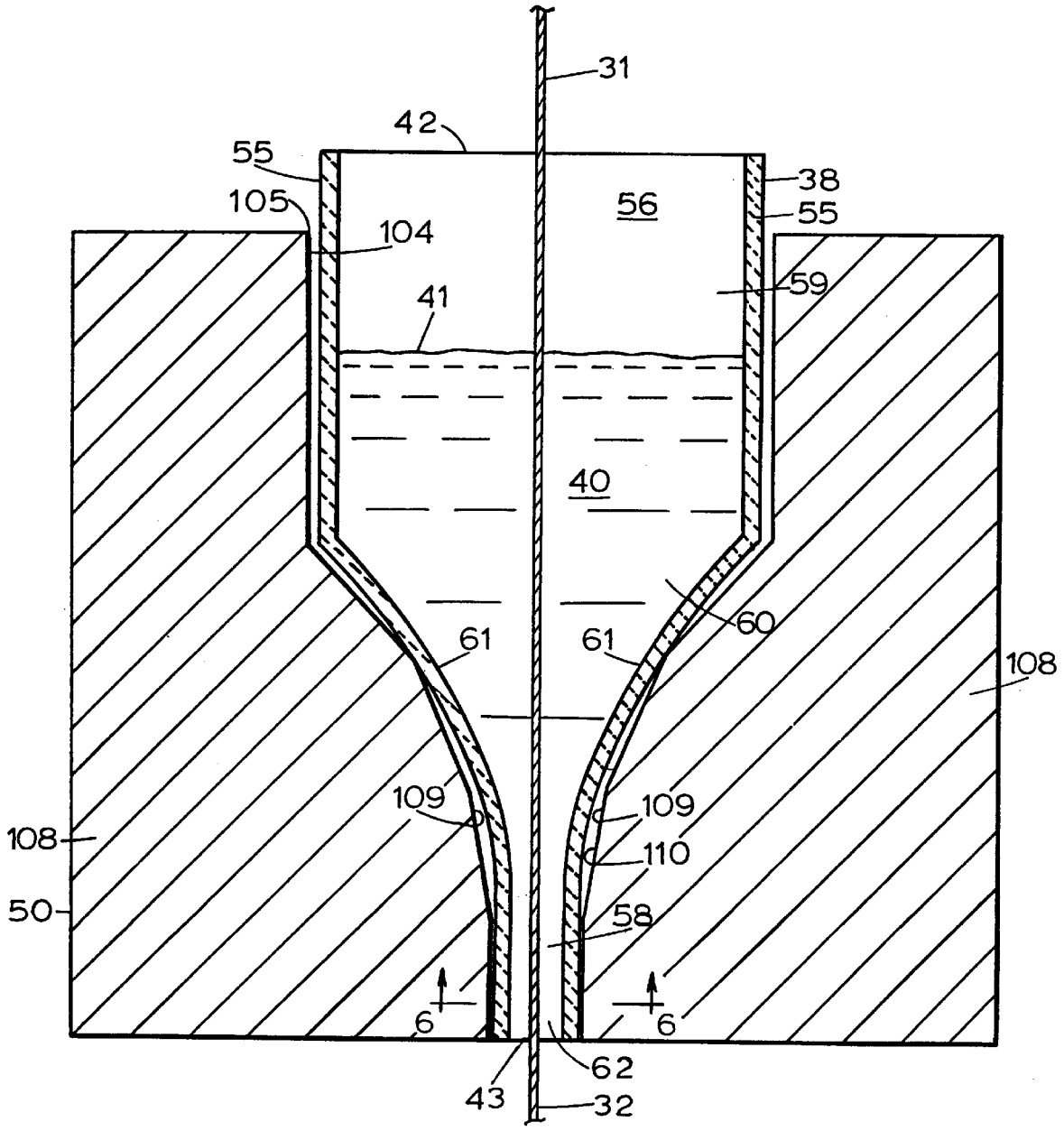
FIG. 3 is an enlarged, vertical sectional view of a portion of the system.
Figure 4:
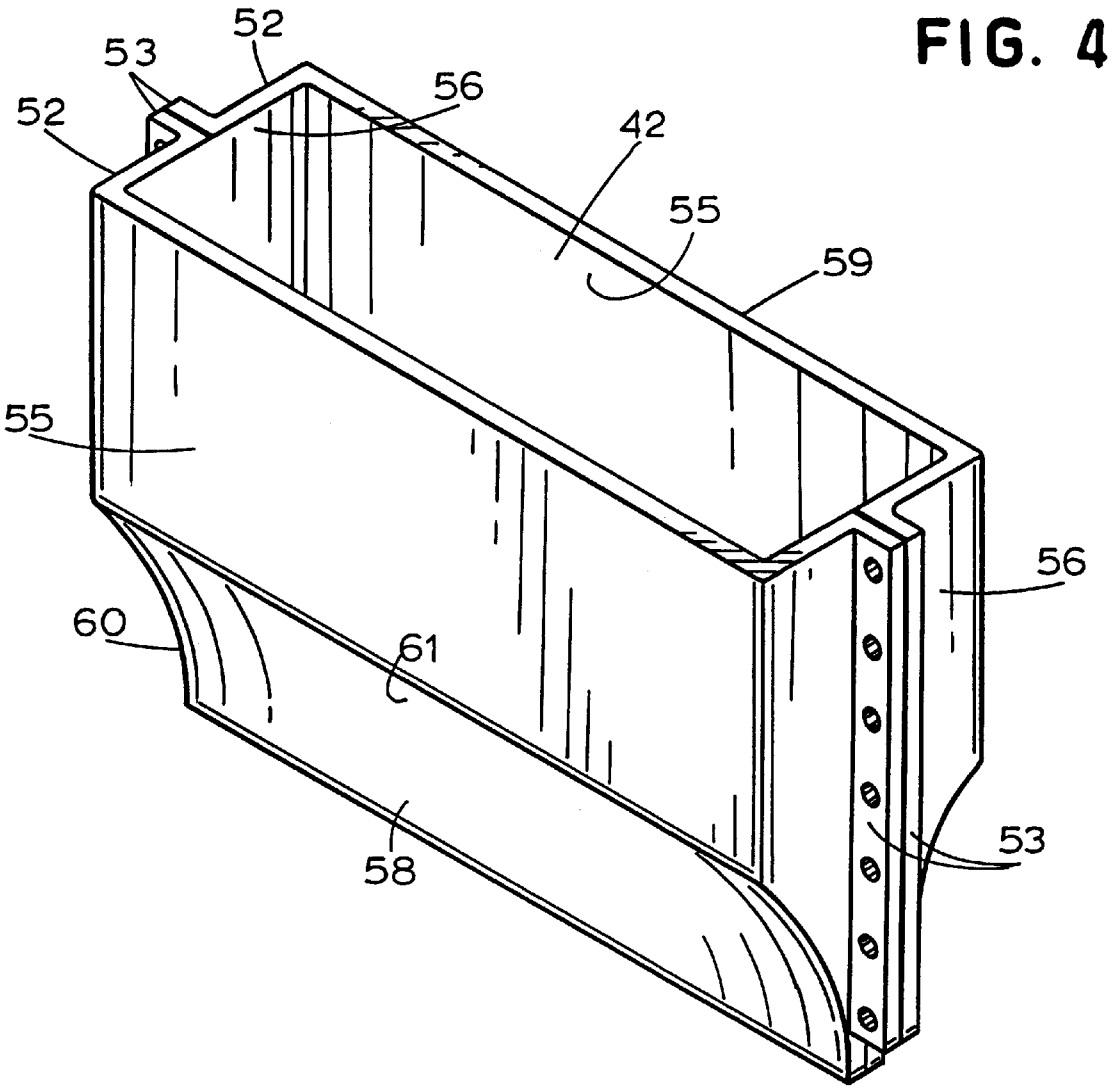
FIG. 4 is a perspective of an embodiment of a vessel employed in the system.
Figure 5:
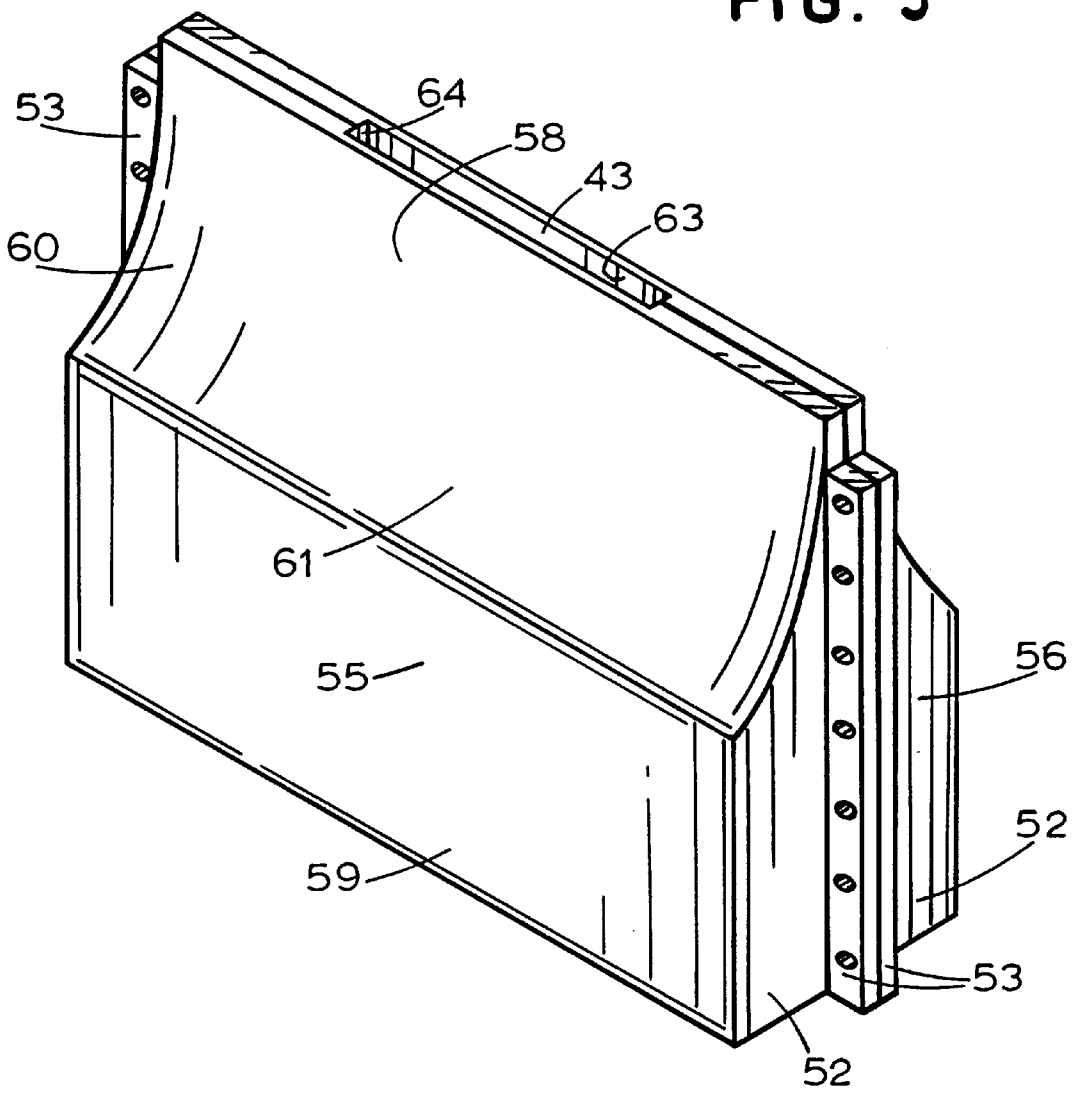
FIG. 5 is a perspective of the vessel of FIG. 4, in an inverted position.

Referring now to FIGS. 1 and 3, a continuous steel strip 32 is unwound from a coil (not shown) and subjected to a conventional pre-treatment operation (also not shown). After pre-treatment, strip 32 is directed by guide rolls 36, 37 along a path which extends through an elongated, slot-like opening 43 in the bottom of an elongated, trough-shaped vessel 38 containing a bath 40 of molten coating metal, in this case, zinc. Bath 40 has a top surface 41, and vessel bottom opening 43 is located below top surface 41 of bath 40. Opening 43 enables the introduction of strip 32 into bath 40, and the strip then moves along a path which extends through bath 40. Movement of strip 32 through bath 40 coats strip 32 with a layer of the coating metal of which bath 40 is composed, and a coated strip 31 exits from bath 40 downstream of bath top surface 41.

Vessel 38 has an open upper end 42 through which coated metal strip 31 moves upwardly after passing through bath 40. Located above vessel 38 is a pair of so-called air knives 44, 44 (FIG. 1) of a type conventionally used to control the thickness of the coating on strip 31, e.g., by directing jets of heated or unheated air or nitrogen against strip 31. Located downstream of air knives 44, 44 is a take-up reel (not shown) onto which coated strip 31 is rewound into a coil which is removable from the take-up reel.

Vessel 38 will now be described in more detail with reference to FIGS. 3–8.

As seen in FIG. 3, vessel 38 has a substantially funnel-shaped, vertical cross-section taken along a vertical plane perpendicular to the plane of strip 32. Also as shown in FIG. 3, vessel 38 has (i) a relatively narrow part 58 extending downstream from opening 43 and (ii) a relatively wide part 59 located downstream of the narrow part.

Referring now to FIGS. 4–8, vessel 38 is composed of two half-vessels 52, 52 joined together at opposite ends along vertical flanges 53, 53. When the two vessel halves are joined together, they define the elongated, trough-shaped vessel 38.

Vessel 38 has a pair of longitudinal sidewalls 55, 55 and a pair of end walls 56, 56 each extending between the ends of sidewalls 55, 55. Sidewalls 55, 55 define the funnel-shaped, vertical cross section shown in FIGS. 3 and 8–9. Vessel 38 and its funnel-shaped cross section include the aforementioned relatively narrow lower part 58 and relatively wide upper part 59. An intermediate vessel part 60 is located between wide upper part 59 and narrow lower part 58 and comprises a pair of sidewall portions 61, 61 converging in an upstream direction from wide upper part 59 toward narrow lower part 58.

The materials from which vessel 38 can be constructed include non-magnetic stainless steel and refractory materials.

Figure 6:
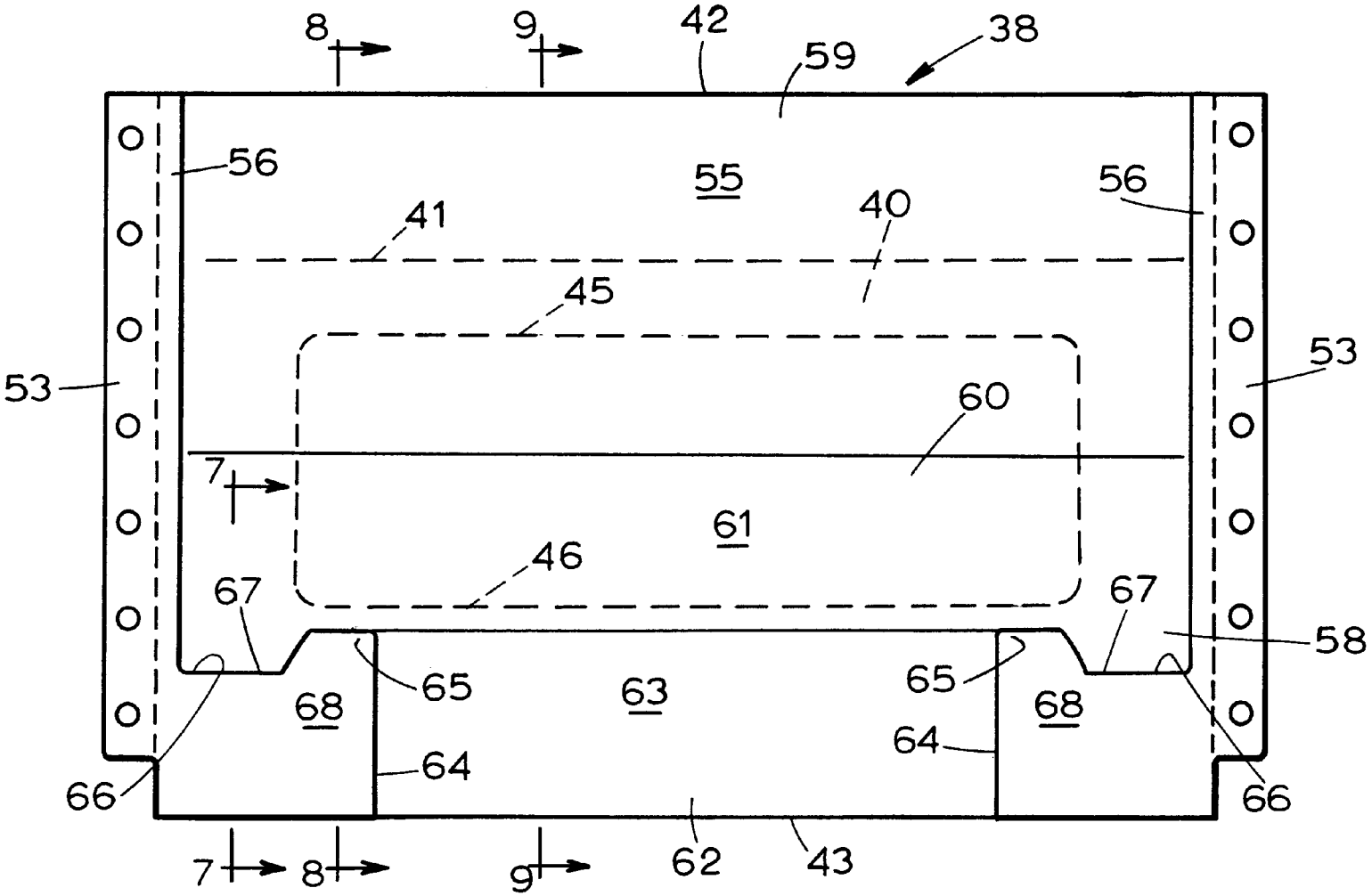
FIG. 6 is a side elevational view of a separable one-half of the vessel of FIGS. 4–5, showing the interior of the vessel.

Referring now to FIG. 6 which illustrates the interior of vessel 38, vessel narrow part 58 includes a passage 62 extending downstream from vessel bottom opening 43. Passage 62 is defined by a pair of opposite, longitudinal sides 63, 63 (only one of which is shown in FIG. 6) and a pair of opposed ends 64, 64, each extending between passage sides 63, 63.

Electromagnet 50 will now be described in greater detail, with reference to FIGS. 2 and 10–12.

Electromagnet 50 comprises a rectangular outer member 100 composed of magnetic material and comprising a pair of opposed, facing longitudinal sidewalls 101, 101, each having a pair of opposite ends, and a pair of end walls 102, 102 each extending between corresponding ends of sidewalls 101, 101. Sidewalls 101, 101 together with end walls 102, 102 define a vertically disposed inner space 104, having open upper and lower ends 105, 106 respectively.

Figure 10:
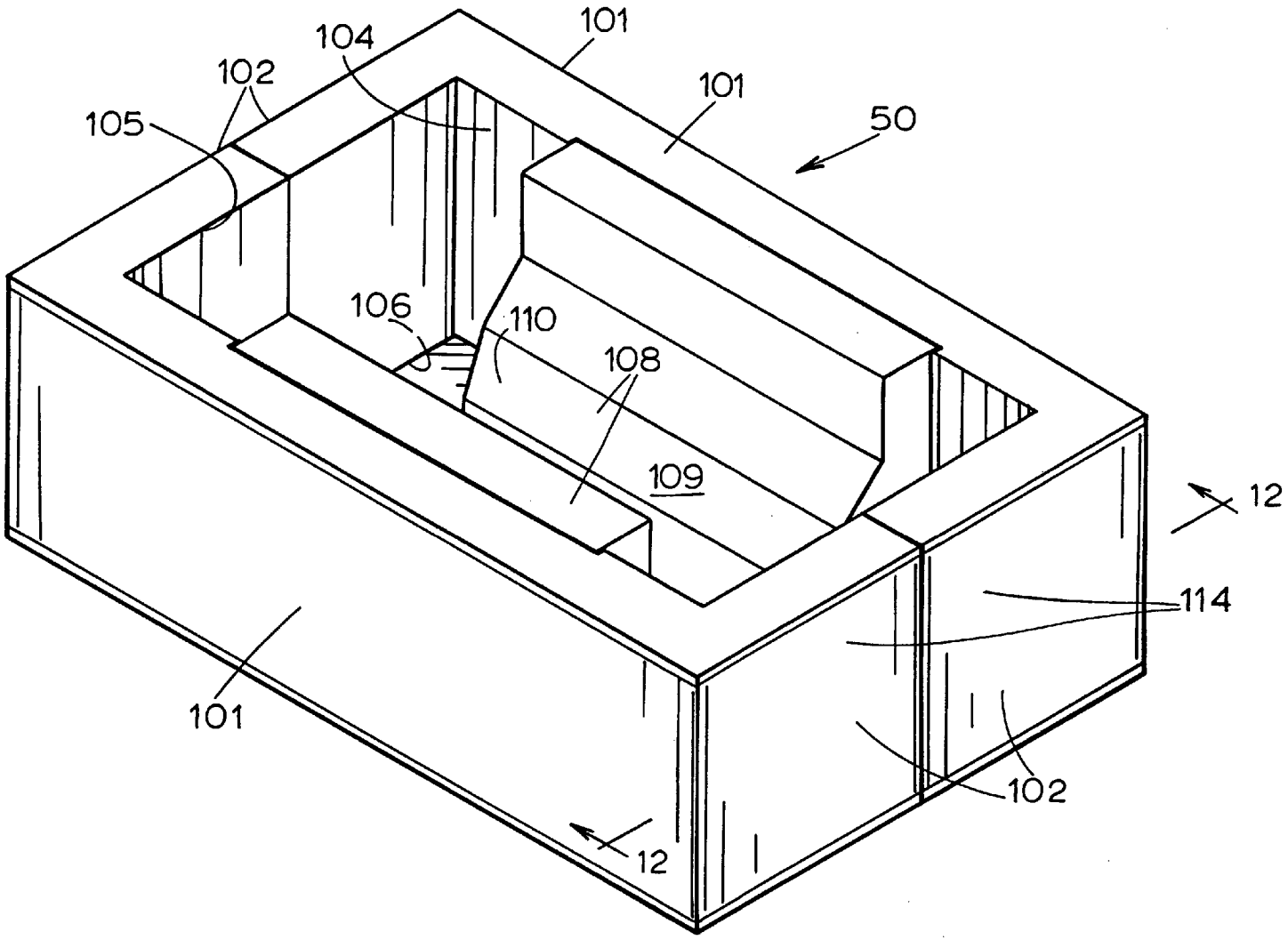
FIG. 10 is a perspective of an embodiment of an electromagnet employed in the system.
Figure 12:
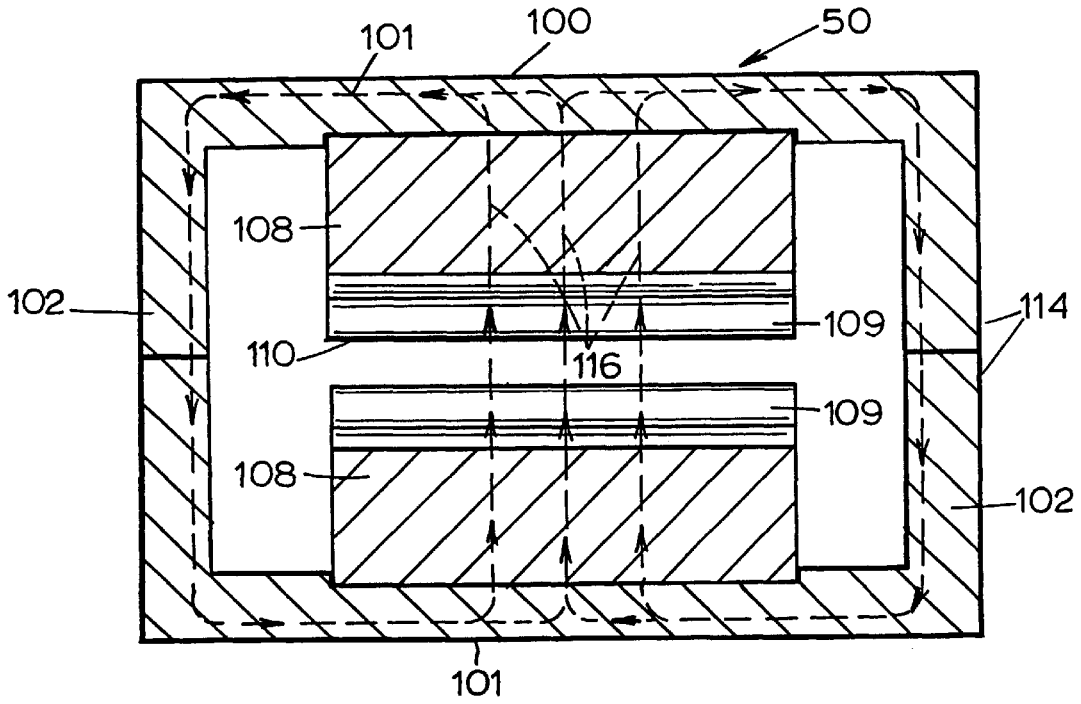
FIG. 12 is a horizontal sectional view taken along line 12—12 in FIG. 10.

Electromagnet 50 also comprises a pair of pole members 108, 108 each composed of magnetic material and each mounted on a respective sidewall 101 of outer member 100, within vertically disposed space 104. Each pole member 108 extends inwardly within space 104 toward the other pole member and terminates at a pole face 109 which is opposed to and faces the pole face 109 on the other pole member 108 (FIGS. 10 and 12). Pole faces 109, 109 define a gap 110 therebetween, to accommodate vessel 38.

Figure 11:
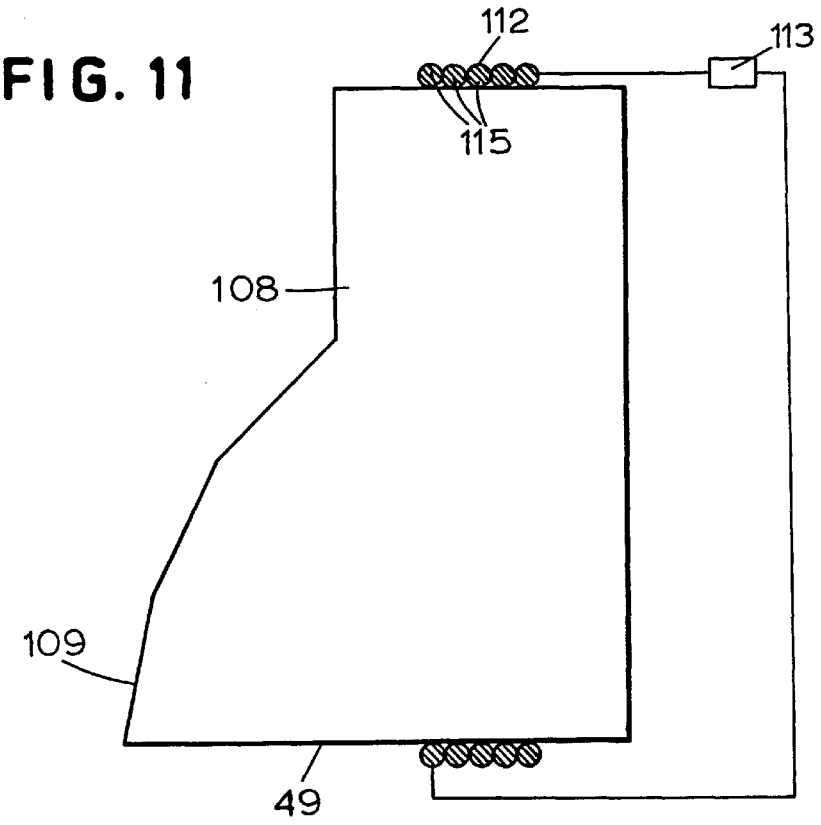
FIG. 11 is an end view, partially in section, showing a portion of the electromagnet of FIG. 10.

As shown in FIG. 11, encompassing each pole member 108 is a coil 112 for conducting electric current. In accordance with one embodiment of the present invention, a time-varying current from a current source 113 is flowed through each coil 112 to generate a magnetic field within the pole member 108 encompassed by that coil 112. Current source 113 is typically adjustable for varying the amperage of the time-varying current introduced into coil 112, in this manner enabling one to control the strength of the magnetic field generated by electromagnet 50.

In another embodiment, a direct current that does not vary with time is flowed through coil 112 to generate the magnetic field. An adjustable current source may be employed in this embodiment, also.

Coil 112 is composed of a multiplicity of coil turns 115 each extending around pole member 108 and each composed of a suitable conductive material such as copper. Coil turns 115 are insulated from each other and from pole member 108 with conventional electrical insulating material (not shown). In the embodiment illustrated in FIG. 11, coil 112 is shown composed of solid wire; in other embodiments, the coil may be composed of copper tubing, for example, through which a cooling fluid may be circulated.

Pole members 108, 108 and outer member 100 provide a path 116 for the magnetic field generated by the flow of current through coil 112. Path 116 is shown in dashed lines, with arrows, in FIG. 12. More particularly, the magnetic field extends from a pole face 109 on one pole member 108 across gap 110 to the pole face 109 on the other pole member 108. The magnetic field then extends sequentially through the other pole member 108, then in opposite directions through the longitudinal sidewall 101 on which that other pole member 108 is mounted, then through both end walls 102, 102 of outer member 100, then through the longitudinal sidewall 101 on which the one pole member 108 is mounted and then through the one pole member 108 back to the pole face 109 on that pole member.

The direction of current flow through each coil 112 on each of pole members 108 is controlled so that the magnetic field generated by each of the coils on each of the pole members extends across gap 110 in the same direction.

Electromagnet 50 is composed of a conventional magnetic material such as ferrite or laminations of electrical steel.

As seen in FIGS. 10 and 12, electromagnet 50 is composed of two half magnets 114, 114 each having an E-shaped horizontal cross section.

Referring to FIG. 3, each pole face 109 of pole member 108 is disposed adjacent a respective sidewall 55 of vessel 38 in close, substantially abutting relation with that sidewall at the vessel's narrow lower part 58 and at converging sidewall portion 61. Each pole face 109 has a contour which substantially follows the contour of adjacent sidewall 55, particularly along converging sidewall portion 61 and along vessel lower part 58, in this embodiment.

The distance between opposed mutually facing pole faces 109, 109 (gap 110) is smallest at narrow vessel part 58 adjacent vessel bottom opening 43. Because the width of pole face gap 110 is smallest at that location, the magnetic field strength (flux density) is highest at that location, compared to other locations downstream of vessel part 58 where gap 110 is wider. In addition, because the resistance to the passage of magnetic flux (i.e., reluctance) is lower in free space than in the molten metal of bath 40, there is a tendency for magnetic flux passing between pole faces 109, 109 to concentrate just below the bottom of bath 40 in passage 62, adjacent vessel bottom opening 43. Accordingly, for a given time-varying current flowing through coils 112, 112, the magnetic force exerted against bath 40 by electromagnet 50 is higher at vessel lower part 58, adjacent vessel bottom opening 43, than at any other location in molten metal bath 40. Generally, magnet power (and magnetic flux) can be adjusted by adjusting the amperage of the time-varying current employed to energize the magnet.

The magnetic flux generated by a time-varying current extends across gap 110 in FIG. 3 and induces eddy currents within bath 40. Referring to FIG. 6, the path 45 of the eddy currents includes a portion 46 which extends along the bottom of bath 40, horizontally in the longitudinal direction of vessel 38, adjacent opening 43. The direction of the eddy currents there is at a right angle to the direction of the magnetic flux there. As a result, the flux and the eddy currents intersect in a horizontal plane, producing magnetic forces directed in an upward direction, as viewed in FIGS. 3 and 6. These forces urge that part of bath 40 that is adjacent bottom opening 43 (i.e., the bottom part of bath 40) in an upward direction away from opening 43 (i.e. downstream as viewed in FIG. 3), an effect known as magnetic levitation.

The magnetic levitation resulting from the upward force exerted against that part of the molten metal bath adjacent bottom opening 43 is a factor in bulk containment of the molten metal bath. The magnetic levitation described above could produce bulk containment of bath 40 of about 98% or more when other expedients (described below), which enhance the effect of magnet 50, are associated with the magnet. Bulk containment due to magnetic levitation of the type described in the preceding sentences can be successful in preventing the escape through strip passage opening 43 of most of the molten coating metal from bath 40, and it can reduce some of the dripping or downward leakage tending to occur along sides 63, 63 and ends 64, 64 of passage 62 (FIG. 6).

Operation of electromagnet 50 agitates bath 40, producing, for example, circulatory or oscillatory agitation streams having a vertical component; this agitation contributes to the dripping or leakage through bottom opening 43 of vessel 38. A device for damping this agitation is indicated generally at 70 in FIGS. 13–15. Device 70 comprises a plurality of pairs of substantially parallel, planar members 71, 72. Preferably, each planar member 71, 72 is composed of a material, such as stainless steel, which is resistant to the thermal conditions in molten metal bath 40. Alternatively, planar members 71, 72 may be coated with a thermal insulating material (not shown).

Each pair of planar members 71, 72 is spaced apart vertically along the path of strip 32, and each pair of planar members 71, 72 extends across bath 40 in a direction transverse to the direction of the strip path. Each pair of planar members 71, 72 defines a slot 73 therebetween. Each slot 73 is aligned with the slot defined by each of the other pairs of planar members 71, 72, to permit the passage of strip 32 through vertically aligned slots 73 as strip 32 moves along its path. Planar members 71, 72 extend across the path of the agitation streams produced by electromagnet 50 and thereby operate to damp the agitation.

Figure 14:
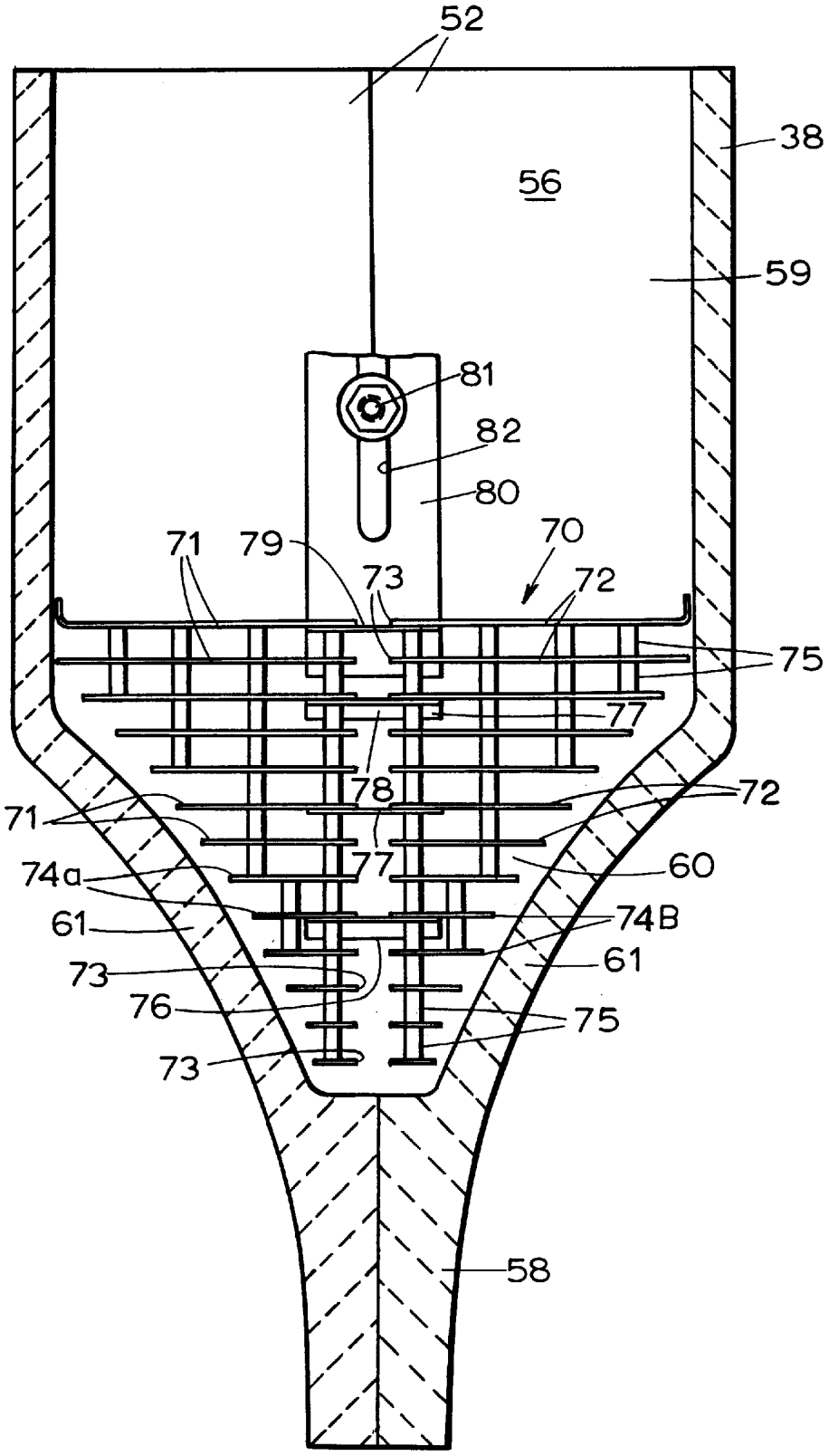
FIG. 14 is an enlarged, vertical sectional view of the interior of the vessel and showing an embodiment of a device for damping agitation of the molten metal in the vessel.

As shown in FIG. 14, some of planar members 71, 72 are located within vessel 38 between downwardly converging vessel sidewall portions 61, 61. These planar members have respective lateral dimensions, in a direction extending between sidewall portions 61, 61 which progressively decrease in a downward direction. Vertically aligned planar members 71, 71 and vertically aligned planar members 72, 72 are maintained in vertically spaced relation by spacers 75, 75 each located between adjacent planar members 71, 71 and between adjacent planar members 72, 72.

In one embodiment, all of planar members 71, 71 in damping device 70 are held together in a unit by their spacers 75 each of which is rigidly secured to the planar members above and below that spacer; and all of planar members 72, 72 in damping device 70 are similarly held together in a unit by their spacers 75. In another embodiment all of the planar members in a unit are held together by vertical rods (not shown) each of which passes through aligned openings in the planar members and spacers. A group of horizontally disposed, vertically spaced cross members 76, 77, 78, 79, located at each end of damping device 70, connects the unit of vertically spaced planar members 71, 71 with the unit of vertically spaced planar members 72, 72 in damping device 70 to provide pairs of horizontally aligned planar members 71, 72.

Damping device 70 has a vertical dimension corresponding preferably to the depth of the bath 40 of molten coating metal to be contained in vessel 38.

Figure 13:
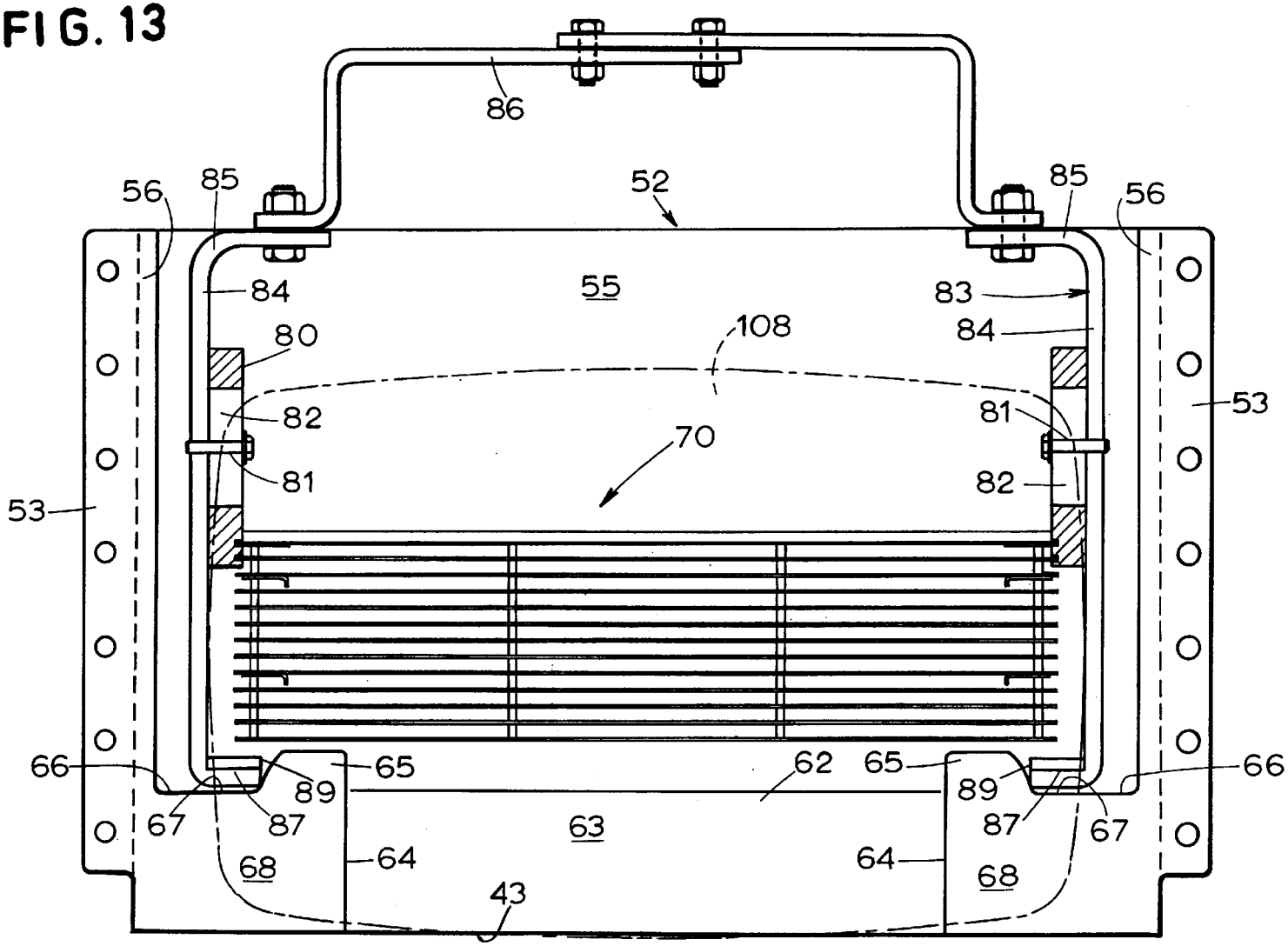
FIG. 13 is an interior view of a vessel-half showing embodiments of certain interior accessories employed in the system to reduce leakage.
Figure 15:
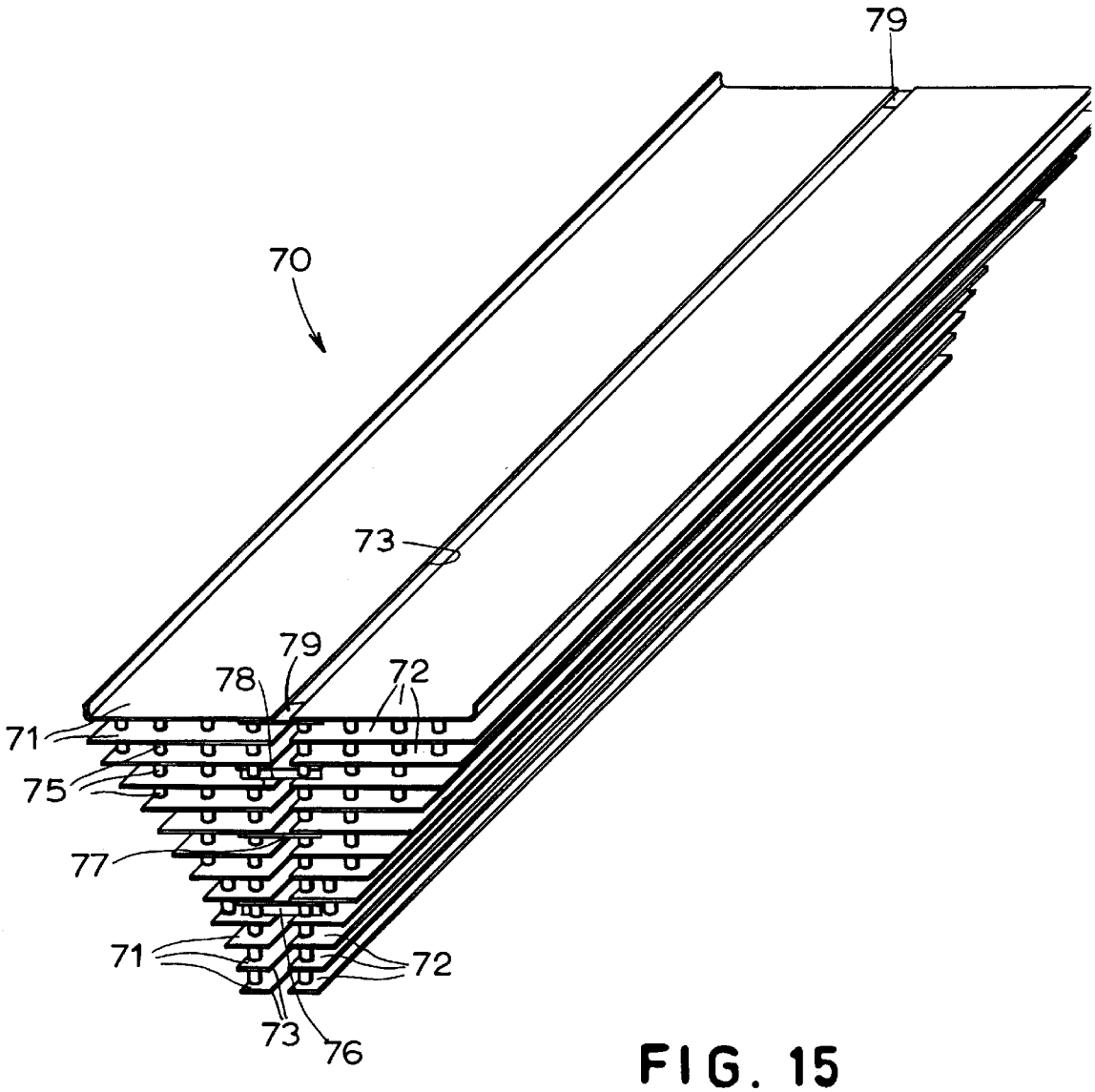
FIG. 15 is a perspective of the agitation-damping device.

In the embodiment of FIGS. 13–15, damping device 70 is suspended from above by end brackets 80, 80 each located at an opposite end of damping device 70 and extending vertically upwardly therefrom. Each end bracket 80 includes a slot 82 for receiving a threaded member 81 for attaching bracket 80 to an arm 84 of a device 83 which, among other things, functions as a mounting frame for damping device 70 in the embodiment of FIG. 13. Device 83 also has another function which will be described later in greater detail.

The above-described expedients for connecting together the planar members in damping device 70 and for mounting damping device 70 within vessel 38 are merely illustrative; other expedients for doing so may be employed. In some embodiments, each pair of planar members 71, 72 may be replaced by a single planar member having a lateral dimension corresponding to the combined lateral dimensions of planar members 71, 72 and having an integral, centrally located, elongated slot in lieu of slot 73.

As previously noted with reference to FIG. 3, there is a gap 110 between the two opposed, mutually facing pole faces 109, 109 of magnet 50. As one may observe from comparing FIG. 3 and FIG. 14, the pairs of planar members 71, 72 extend horizontally between opposed, mutually facing pole faces 109, 109, in that part of gap 110 above narrow lower part 58 of vessel 38. That part of gap 110 described in the preceding sentence is wider than that part of the gap in narrow lower part 58. The wider the gap between pole faces 109, 109, the lower the magnetic flux density across that part of the gap. Increased magnetic flux density is desireable, and flux density can be increased by decreasing the effective gap between pole faces 109, 109. One expedient for doing so is described in the following paragraph.

In a preferred embodiment, planar members 71, 72 are composed of ferromagnetic material, e.g., carbon steel or magnetic stainless steel. Compared to the metal of molten bath 40 (e.g. zinc), both of the materials described in the preceding sentence are more permeable to magnetic flux and provide a relatively low reluctance flow path for the magnetic flux which extends between pole faces 109, 109. By composing planar members 71, 72 of these materials, the effective gap between pole faces 109, 109 is reduced. More particularly, the effective gap is reduced to (a) the width of slot 73 plus (b) the distance between the outside edge 74*a* of planar member 71 and the adjacent pole face 109 plus (c) the distance between the outside edge (74*b*) of planar member 72 and adjacent pole face 109.

Figure 21:
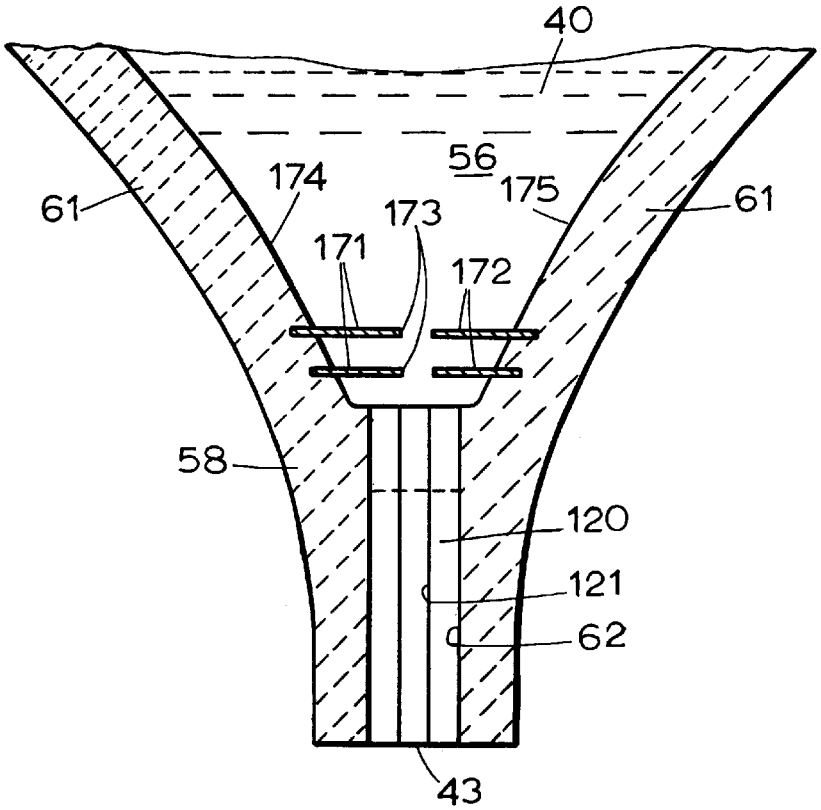
FIG. 21 is a fragmentary, vertical sectional view illustrating an accessory within the vessel for reducing the effective gap between opposed, mutually facing pole faces of an electromagnet located outside the vessel.

FIG. 21 illustrates an alternative embodiment of an expedient for reducing the effective gap between pole faces 109, 109. In this embodiment, vertically aligned pairs of horizontally disposed, spaced apart planar elements 171, 172 define a space 173 therebetween through which extends the path for strip 32. Each pair of planar elements 171, 172 is disposed in gap 110, between pole faces 109, 109, in that part of gap 110 above narrow lower part 58 of vessel 38 (consider FIGS. 3 and 21 together). Both planar elements in a pair lie in the same horizontal plane. Each planar element extends from a respective inner sidewall surface 174, 175 of converging sidewall portions 61, 61, across bath 40 toward the other planar element, in a direction transverse to the direction of the strip path. Planar elements 171, 172 are composed of ferromagnetic material, e.g. magnetic stainless steel, thereby reducing the effective gap between mutually facing pole faces 109, 109 in the same manner as planar members 71, 72 (see the preceding paragraph).

In the embodiment illustrated in FIG. 21, planar elements 171, 172 are partially embedded in sidewall portions 61, 61 of vessel 38. Other expedients for attaching planar elements 171, 172 to these sidewall portions may be employed.

Figure 7:
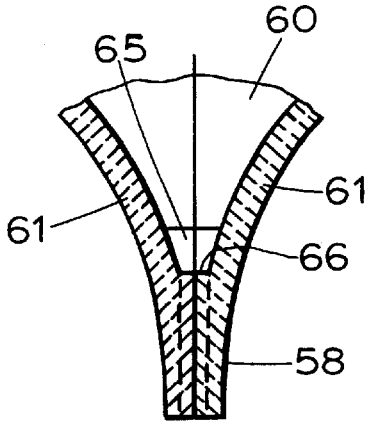
FIG. 7 is a fragmentary vertical sectional view of the vessel taken along line 7—7 in FIG. 6, but showing the two halves of the vessel joined together.
Figure 8:
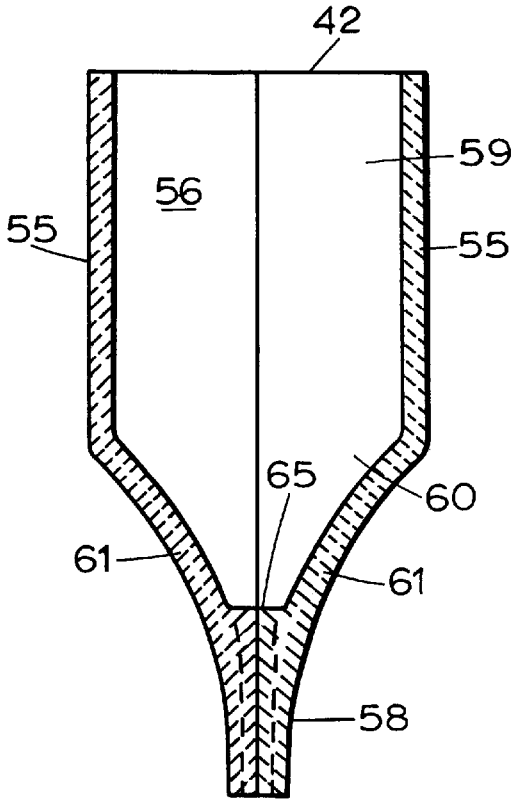
FIG. 8 is a vertical sectional view similar to FIG. 7 and taken along line 8—8 in FIG. 6.
Figure 9:
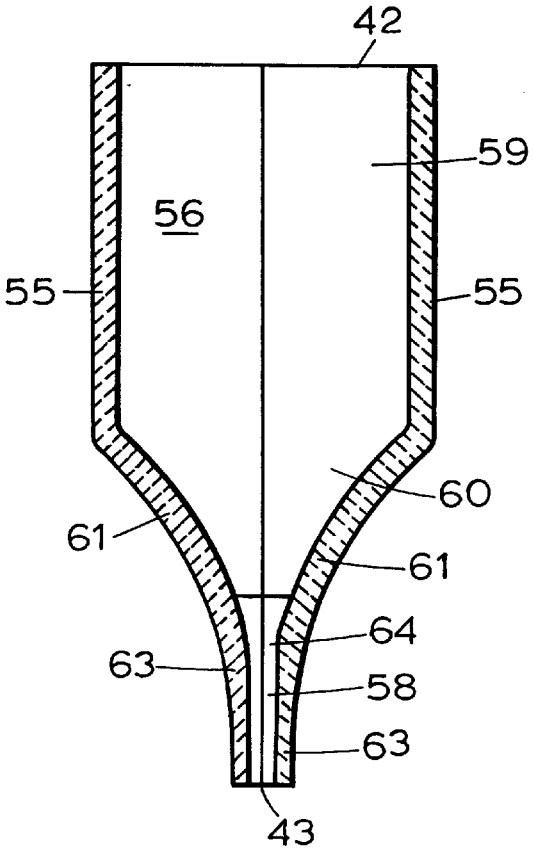
FIG. 9 is a vertical sectional view, similar to FIG. 8, taken along line 9—9 in FIG. 6.

Referring now to FIGS. 6–8 and 13, passage 62, as previously noted, has a pair of opposed ends 64, 64 each spaced from an adjacent end wall 56 of vessel 38. There is a space 67 between vessel end wall 56 and passage end 64. A dam 65 extends upwardly at each passage end 64 and extends laterally across the vessel interior between opposed converging sidewall portions 61, 61 of vessel intermediate part 60 (FIGS. 7–8). Each dam 65 occupies part of the space between vessel end wall 56 and passage end 64. Located at each end of vessel 38, between a vessel end wall 56 and a dam 65 is a sump 66. Each sump 66 comprises structure for confining a pool of molten metal. Sump 66 is located atop a vessel bottom wall portion 68 extending between end 64 of passage 62 and adjacent end wall 56 of vessel 38.

In the embodiment shown in FIGS. 3 and 13, each pole member 108 (and its pole face 109) extends (a) downwardly to the bottom of passage 62 (corresponding to vessel bottom opening 43) and (b) longitudinally to a location adjacent each end space 67 of vessel 38. Accordingly, when flux passes between pole faces 109, 109, there is flux at the bottom of passage 62 and at end spaces 67, 67.

Referring now to FIGS. 13 and 16–18, illustrated therein is another expedient for reducing the leakage or dripping of molten metal through bottom opening 43. This expedient is in the form of an electric current conductor, one embodiment of which is indicated generally at 83 in FIG. 13.

As previously noted, when electromagnet 50 is operated in conjunction with a time-varying electric current (AC or pulsating DC), the magnetic flux developed by the electromagnet generates eddy currents in molten metal bath 40. These eddy currents normally follow a looping path that is indicated diagrammatically at 45 in FIG. 6 and that includes a portion 46 which flows along the bottom of bath 40 in the longitudinal direction of vessel 38. Current conductor 83 defines a low resistance conductive path to be followed by that part of the eddy current other than portion 46 that flows along the bottom of bath 40.

Referring to FIG. 13, current conductor 83 is a generally U-shaped element composed of electrically conductive material such as copper. Conductor 83 comprises (i) a pair of vertical arms 84, 84 each disposed adjacent a respective end wall 56 of vessel 38 and (ii) a cross member 86. Each arm 84 has an upper end portion 85 connected by cross member 86 to upper end portion 85 of the other arm. Current conductor 83 also comprises a pair of lower terminal end portions 87, 87 each connected to a respective arm 84 and each located within a respective end space 67 of vessel 38 above wall portion 68 of the vessel and in electrical contact with that part of bath 40 located in sump 66. Although not shown in FIG. 13, conductor 83 is electrically insulated against electrically conductive contact with each of damping device 70 and bath 40 (except that part of bath 40 in sump 66).

In the embodiment of FIG. 13, eddy current flows through current conductor 83, rather than circulating through bath 40 along path 45 (FIG. 6), and the eddy current is directed by current conductor 83 into end space 67 of vessel 38, i.e. into that part of molten metal bath 40 located in sump 66.

As previously noted, the magnetic force produced by the cooperation between the magnetic field generated by electromagnet 50 and the eddy currents developed in bath 40, urges molten metal bath 40 away from vessel bottom opening 43 and maintains the bottom of bath 40 above vessel bottom opening 43.

The upwardly directed magnetic force exerted against the bottom of bath 40 at any location along the length of vessel 38 is a function of both (a) the amount of magnetic flux there and (b) the amount of eddy current there. Pole faces 109, 109 face each other across end spaces 67, 67, thereby providing magnetic flux there. As previously noted, current conductor 83 directs the eddy current generated by electromagnet 50 into end spaces 67, 67, adjacent the bottom of vessel 38. Absent current conductor 83, at least some of the eddy current could follow a path 45 that bypasses end spaces 67, 67 (see FIG. 6). By employing current conductor 83 having uninsulated terminal end portions 87, 87 located at end spaces 67, 67, in sumps 66, 66, eddy current is more concentrated in end spaces 67, 67 then it would be absent current conductor 83. This increases the upwardly directed magnetic force at end spaces 67, 67 which in turn contributes to a reduction in dripping or leakage through vessel bottom opening 43, particularly along ends 64, 64 of passage 63.

Current conductor 83 also functions to substantially reduce the flow of circulating eddy current along the top of bath 40. This is desireable because eddy current flowing along the top of bath 40 would cooperate with whatever magnetic field that is generated there by electromagnet 50 to produce a magnetic force which would urge bath 40 downwardly there. Because current conductor 83 substantially reduces the flow of circulating eddy current along the top of the bath, there is also a substantial reduction in the magnetic force urging the bath downwardly there. This, in turn, increases the effectiveness of the magnetic force urging the bath upwardly at the bottom of the bath, in turn contributing to a reduction in the dripping or leakage of the bath through vessel bottom opening 43.

As previously noted, the magnetic flux density generated by electromagnet 50 is highest at those locations where gap 110 between opposed pole faces 109, 109 of electromagnet 50 is the smallest. Similarly, the eddy currents generated in bath 40 are relatively high at those locations where gap 110 is relatively small, i.e. adjacent the bottom of bath 40. In addition, current conductor 83 concentrates the eddy current along the bottom of bath 40 adjacent the top of passage 63.

Figure 16:
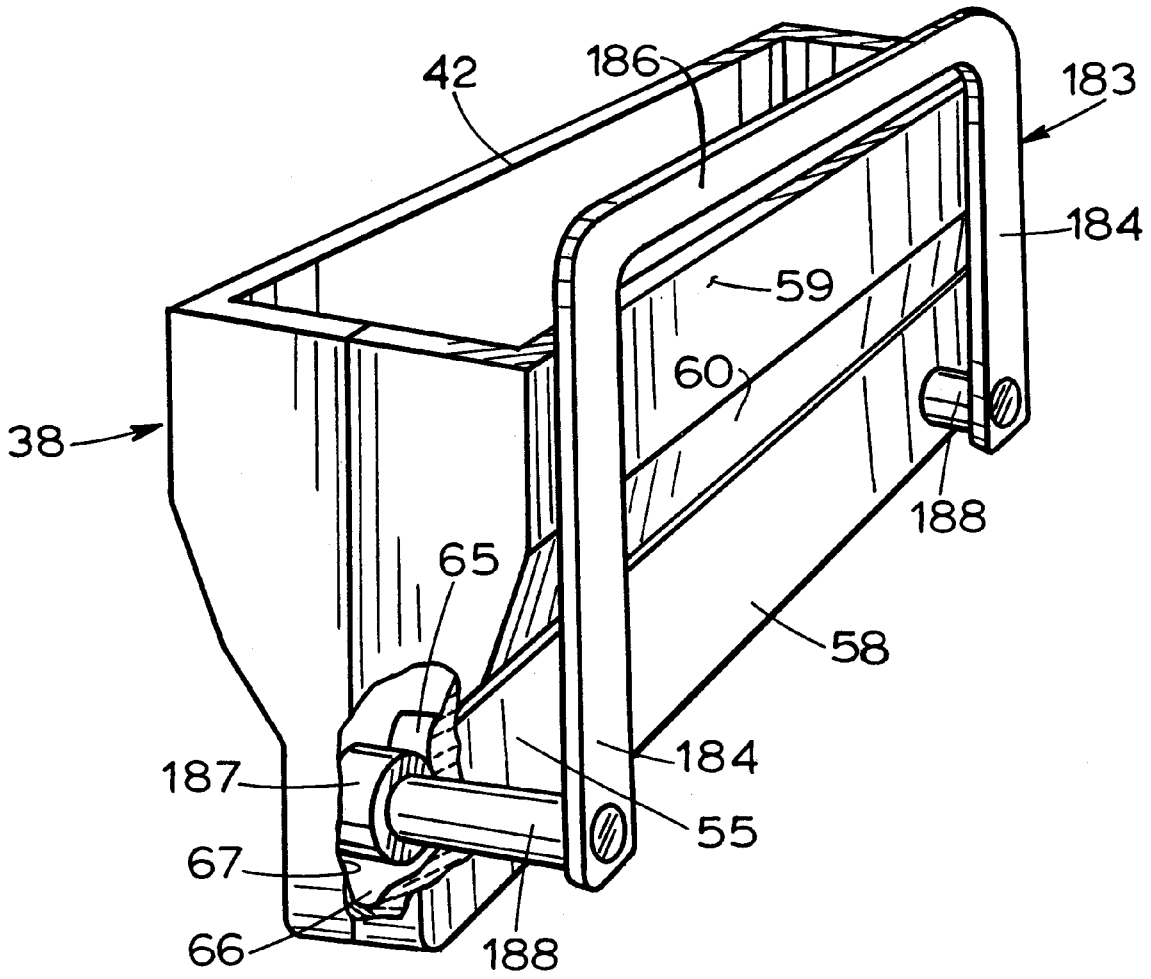
FIG. 16 is a perspective showing the vessel and one embodiment of a current conductor employed in the system.

As previously noted, current conductor 83 has vertically disposed arms 84, 84 much of which are located within bath 40. An alternative embodiment is illustrated in FIG. 16 wherein a U-shaped current conductor, indicated generally at 183, has vertically disposed arms 184, 184 located entirely outside of bath 40 and has a cross member 186 connecting arms 184, 184. Only the terminal end portions 187, 187 of current conductor 183 are located in bath 40, at end spaces 67, 67 in sumps 66, 66. A connecting portion 188 extends from each terminal end portion 187 through a longitudinal sidewall 55 of vessel 38 to a respective arm 184.

The foregoing discussion was in the context of electromagnet 50 being operated with a time-varying electric current, either AC or pulsating DC. In such a case, the resulting magnetic flux produces eddy currents in bath 40, and these eddy currents flow through the low resistance path provided by current conductor 83 or 183.

In another embodiment of the present invention, electromagnet 50 may be operated with a current which does not vary with time, e.g., non-pulsating direct current. In such an arrangement, each coil 112 on a pole member 108 of magnet 50 (FIG. 11) is connected to a source of direct current which flows uninterruptedly through coil 112 to generate a magnetic field which flows through bath 40 between facing pole faces 109, 109 (FIG. 3). The magnetic field generated in this manner does not produce eddy currents in bath 40. Instead, an outside source is employed to introduce direct current into bath 40 at a location between pole faces 109, 109. One embodiment of such an arrangement is illustrated in FIG. 20 (on last drawing sheet).

Figure 20:
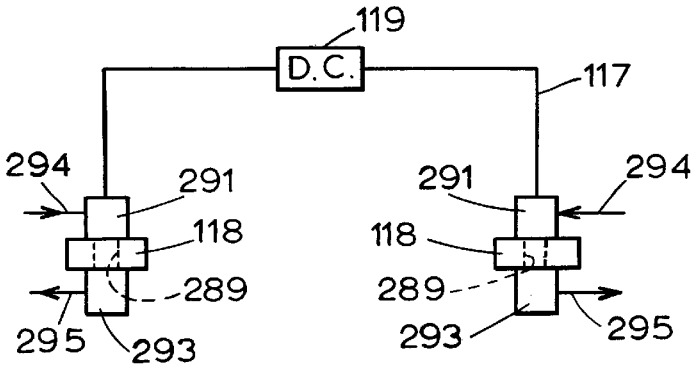
FIG. 20 is a circuit diagram showing a current conductor employing direct current.

In the embodiment of FIG. 20, a DC current source 119 is connected by a line 117 to a pair of terminal end portions 118, 118 each located within a respective end space 67 of vessel 38 above bottom wall portion 68 and in electrical contact with the bath in sump 66 there (FIG. 6). The direct current flows from one terminal end portion 118 along the bottom of bath 40, in the longitudinal direction of vessel 38. This direct current cooperates with the magnetic field generated by the uninterrupted flow of direct current through coils 112 on pole members 108 of electromagnet 50 (FIG. 11). The cooperation described in the preceding sentence produces a magnetic force which urges molten metal bath 40 upwardly away from bottom opening 43 in vessel 38.

In all embodiments of the present invention, the terminal end portion (87, 187, or 118) is composed of a conductor which has a lower electrical resistance than molten metal bath 40. Typically, the terminal end portion is composed of copper whereas the bath of molten coating metal is composed of zinc. The copper in the terminal end portion will metallurgically combine with the molten zinc in the bath to form an alloy of copper and zinc (brass) which is absorbed into the bath. The net result is erosion of the terminal end portion. From the standpoint of the present invention, the phenomenon described in the preceding two sentences is undesireable; accordingly, expedients are provided to prevent the erosion of the copper terminal end portions in the molten zinc of bath 40.

Figure 17:
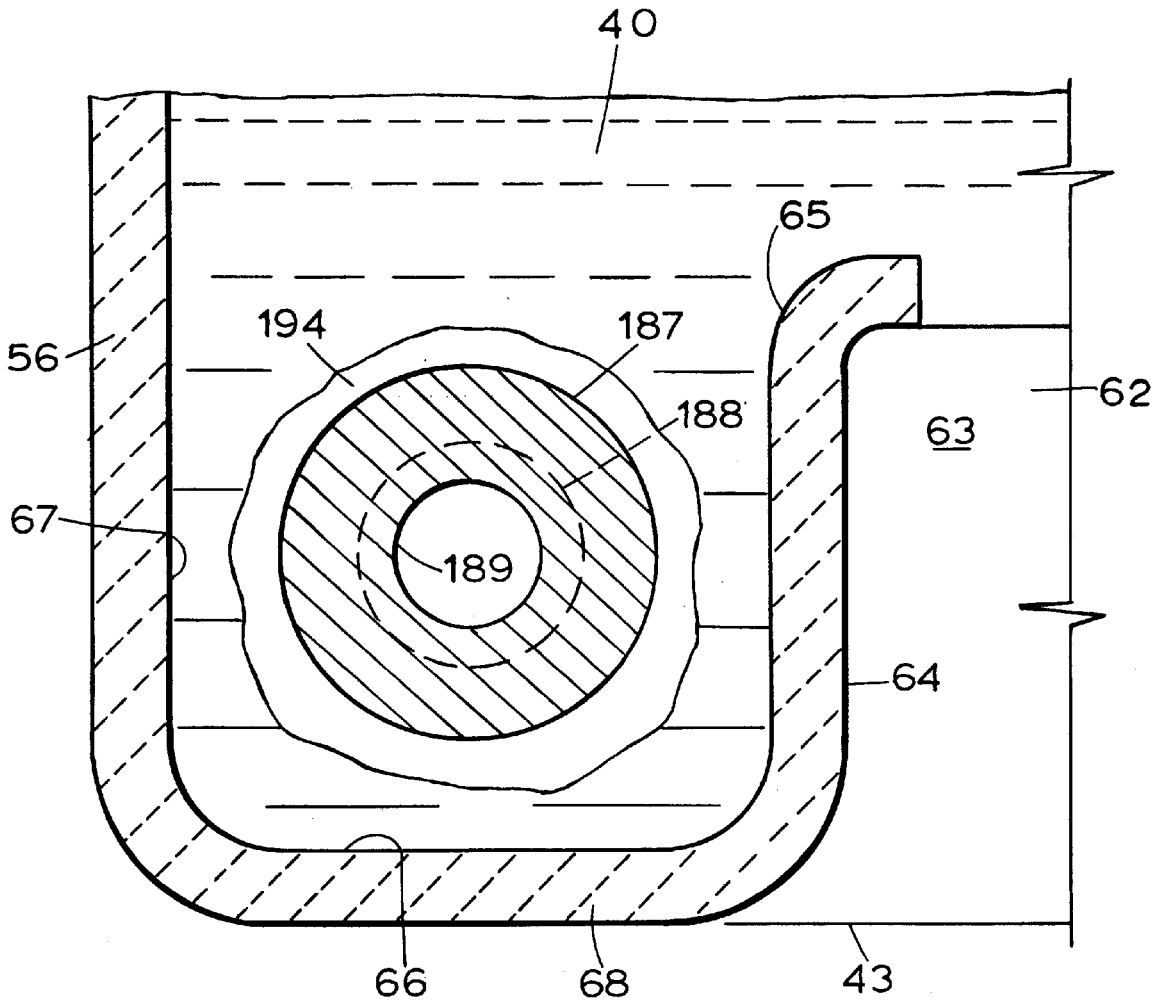
FIG. 17 is an enlarged, fragmentary sectional view showing a terminal portion of a current conductor.

Referring to FIGS. 17 and 18, each terminal end portion 187 is provided with an internal channel 189 communicating with an internal channel 190 in connecting portion 188. Internal channel 190 is connected to an inlet conduit 191 communicating with a source 192 of cooling fluid, e.g. refrigerated water. Cooling fluid flows from source 192 through inlet conduit 191 and channel 190 into channel 189 to chill lower terminal end portion 187, thereby solidifying some of the zinc coating metal in sump 66 as a crust or layer 194 around terminal end portion 187 (FIG. 17). Crust 194 protects copper terminal end portion 187 against erosion in the molten zinc of bath 40. Spent cooling fluid is withdrawn from channel 189 through an outlet conduit 193 (FIG. 18).

(In FIG. 17, dam 65 and vessel bottom wall portion 68 are shown with thickness dimensions that are relatively small compared to the thickness dimensions of the corresponding elements in FIGS. 6 and 13. Either variation may be employed.}

In the embodiment of FIG. 20, employing non-pulsating direct current, terminal end portion 118 has an internal channel 289 connected to an inlet conduit 291 and an outlet conduit 293. Inlet conduit 291 is connected by a line 294 to a source of cooling fluid (not shown). Outlet conduit 293 is connected by a line 295 to a drain for spent cooling fluid (not shown). Circulation of cooling fluid through channel 289 produces a protective layer or crust of solidified zinc coating metal around copper terminal end portion 118 to protect terminal end portion 118 against erosion in the molten zinc of bath 40.

As previously noted, current conductor 183 has arms 184, 184 and a cross member 186 which are located outside of molten metal coating bath 40 (FIG. 16). A variation of the embodiment described in the preceding sentence is illustrated in FIG. 19 wherein at least a portion of each arm 184 is immersed in molten metal coating bath 40. Protecting that portion of arm 184 which is immersed in bath 40 is an insulation layer 196 for electrically and thermally insulating the immersed arm portion from molten metal coating bath 40. That part of arm 184 which is adjacent the junction of arm 184 with lower terminal end portion 187 is protected from the molten coating bath by solidified coating metal crust 194 (discussed above in connection with FIG. 17).

An electrical and thermal insulating layer, similar to layer 196 in FIG. 19, would be employed in the embodiment of FIG. 13 to protect that portion of each arm 84 which is immersed in bath 40. Terminal end portion 87 on current conductor 83 is not chilled in the embodiment shown in FIG. 13, but is exposed to the bath of molten coating metal. An unprotected terminal end portion, such as 87, can be employed in situations where the molten coating metal does not alloy with the conductor metal (e.g. copper) of which terminal end portion 87 is composed. As a less desireable alternative, terminal end portion 87 can be protected with a layer of insulation (such as layer 196 in FIG. 19), except for the tip 89 of terminal end portion 87.

Figure 22:
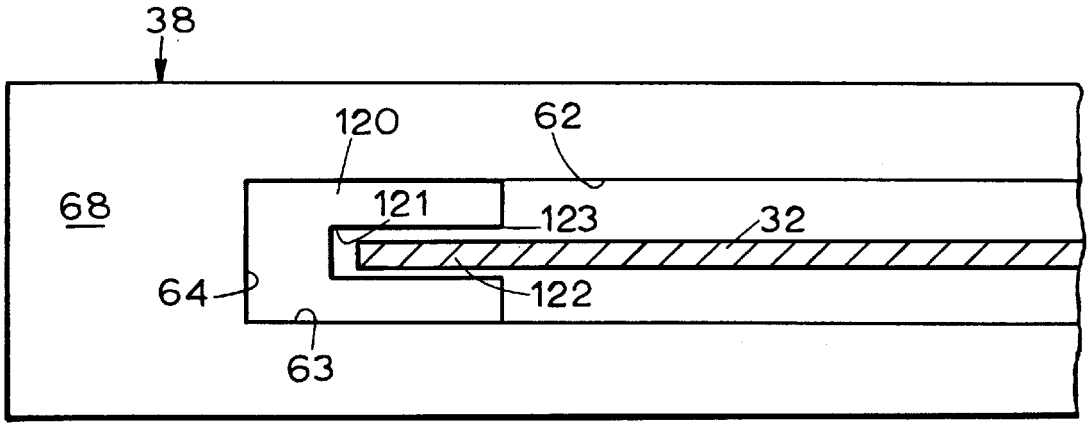
FIG. 22 is a bottom view showing one of a pair of notched, strip-guiding elements each located at a respective opposite end of the vessel bottom.

Referring now to FIGS. 21–22, there is a guide element 120 located at each end 64 of passage 62 which, as noted above, is located in the narrow lower part 58 of vessel 38 (See FIGS. 6 and 13). Each guide element 120 has a horizontally disposed notch 121 having an open end 123 facing the corresponding open end of the corresponding notch in guide element 120 at the other end 64 of passage 62. Each notch 121 constitutes structure for engaging a respective edge portion 122 of steel strip 32 as the strip moves through passage 62. Notches 121, 121 maintain strip 32 substantially centered between mutually facing pole faces 109, 109 of magnet 50 and restrain side to side movement of steel strip 32 as it moves through vessel 38. This counteracts the tendency of electromagnet 50 to attract strip 32 toward one of the two opposed, mutually facing pole faces 109, 109 which in turn tends to cause side-to-side movement of strip 32 as it moves through the vessel, a movement which is undesirable.

Figure 23:
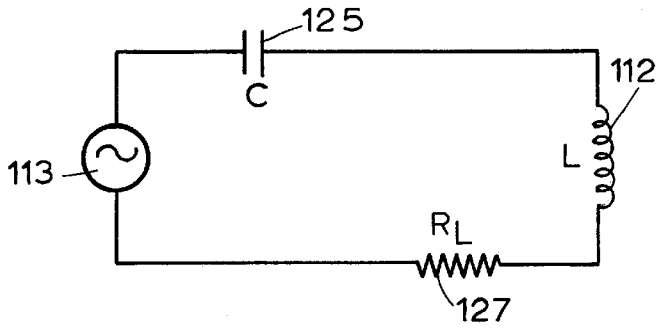
FIG. 23 is a circuit diagram of a series electrical circuit for the electromagnet.
Figure 24:
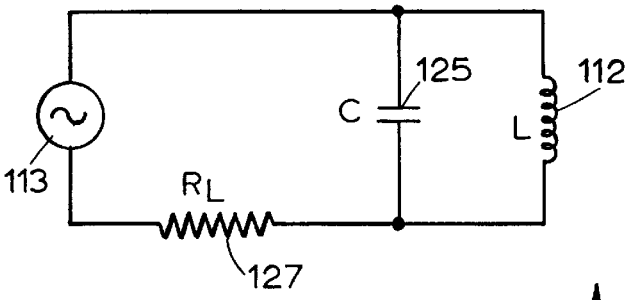
FIG. 24 is a circuit diagram of a parallel electrical circuit for the electromagnet.

Referring now to FIGS. 23–24, FIG. 23 illustrates a series LCR circuit for electromagnet 50, and FIG. 24 illustrates a parallel LCR circuit for electromagnet 50. Each LCR circuit includes a source of time-varying current 113, a capacitor 125, a coil 112 for each pole member 108 of magnet 50 and a resistance 127. In both FIGS., C represents the capacitance of the circuit, L represents the inductance of the circuit (which includes one coil 112 for each pole member 108) and $R_L$ represents the resistance of the coils. Inductance varies directly with the flux generated by the coil and the number of turns in the coil and varies inversely with the current level (amperage). Inductance produces a lag in frequency compared to the frequency of the power source; capacitance produces a lead in frequency.

The series LCR circuit illustrated in FIG. 23 is operated in such a manner that the current in the circuit automatically increases whenever there is a drop in the level of the bottom of molten metal bath 40, thereby increasing the upward magnetic force exerted on the bottom of the bath. This feature is discussed in the following four paragraphs.

Figure 25:
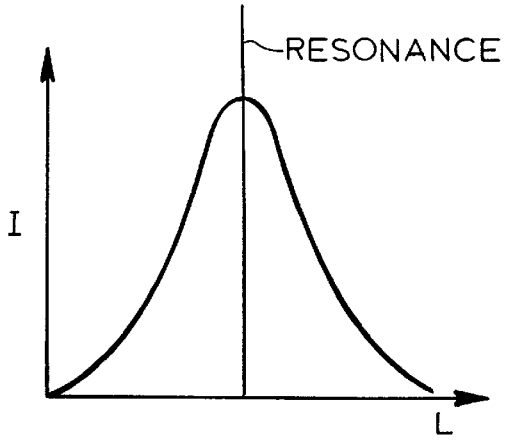
FIG. 25 is a graph plotting current (I) versus inductance (L) for the series circuit of FIG. 23.

Referring to FIG. 25, this figure plots current as a function of inductance for a system employing the series LCR circuit of FIG. 23. The vertical line in FIG. 25 labeled "Resonance" refers to a condition of the series LCR circuit of FIG. 25 at which the lead in frequency due to the capacitance of the circuit matches or balances the lag in frequency due to the inductance of the circuit, so that the natural frequency of the circuit equals the frequency of the power supply. For a given power supply, a condition of resonance provides more power for the magnet energized by the circuit than a condition of non-resonance.

When the series LCR circuit of FIG. 25 is operated close to its resonance, the current level of the circuit is a function of how close to resonance one is operating. If capacitance (C) and resistance (R) are fixed, current (I) can be plotted as a function of inductance (L) (see FIG. 25); variations in inductance (L) thus effect current (I).

System 30 and magnet 50 are normally operated so that the bottom of bath 40 is maintained above bottom opening 43 in vessel 38 (see FIG. 3). At any location between pole faces 109, 109, the magnetic flux density across free space (air) is greater than the magnetic flux density would be across the molten metal of bath 40 at the same location. If there is an increase in the mass of bath 40, e.g. by adding more molten coating metal to the bath, the increased mass initially causes the bottom of the bath to descend toward vessel bottom 43. When this occurs, a part of gap 110 previously occupied by air (free space) becomes filled with molten coating metal; accordingly, the inductance (L) in the system decreases because the descended molten metal acts as a magnetic shield that reduces the passage of magnetic flux in that part of gap 110 where the bath has descended. The shield decreases the flux at that location and the total flux across gap 110, and a decrease in total flux produces a decrease in inductance.

If the series LCR circuit of FIG. 23 is operated so that the inductance (L) in the graph of FIG. 25 is to the right of the vertical line labeled "Resonance", a decrease in inductance (L) will produce an increase in current (I). This, in turn, will increase the total flux across gap 110, thereby increasing the magnetic force acting to urge upwardly the bottom of bath 40. As a result, a system employing the series LCR circuit of FIG. 23, and operated in the manner described above, is self-adjusting to compensate for a drop in the bottom of bath 40.

Continuous strip 32 is typically a flat, thin, planar element, e.g. a steel sheet. However, a strip having the configuration described in the preceding sentence is merely illustrative of one type of continuous strip with which the present invention may be practiced. Other strip configurations such as rods, bars, wires, tubes and shapes, may be employed so long as leakage of the molten coating metal from the hot dip coating bath can be minimized in accordance with the present invention.

The present invention has been illustrated in the context of a strip passage opening underlying the vessel containing the molten metal coating bath. However, the present invention may also be employed in a system wherein (i) the strip passage opening is located in the sidewall of a vessel and (ii) the vessel contains a molten metal coating bath having a top surface located above the level of the strip passage opening.

The foregoing detailed description has been given for clearness of understanding only and no unnecessary limitations should be understood therefrom, as modifications will be obvious to those skilled in the art.

What is claimed is:

1. A system for hot dip coating a steel strip, said system comprising:

an elongated, trough-shaped vessel for holding a bath of molten coating metal;

said vessel having a pair of opposed side walls extending in the longitudinal direction of said vessel and a pair of opposed end walls;

said vessel having a relatively wide upper part and a relatively narrow lower part;

said side walls converging in a downward direction toward said lower part;

said vessel having an elongated opening at the bottom of said lower part;

means for moving a steel strip along a path extending in a downstream direction through said bottom opening and through said bath;

and an electromagnet disposed alongside said vessel and comprising means for preventing the escape through said opening of the bulk of the molten metal from said bath;

said electromagnet comprising a pair of opposed pole members each composed of magnetic material and each disposed along a respective side wall of said vessel;

said pole members having opposed, mutually facing pole faces;

each of said pole faces being disposed adjacent a respective side wall of the vessel in close substantially abutting relation with that side wall at the vessel's lower part and at that part of said side wall that converges toward the other side wall;

each of said pole faces having a contour which substantially follows the contour of the adjacent side wall along that part of said side wall that converges toward the other side wall and along the vessel's lower part;

said electromagnet further comprising means for agitating said bath and means for damping the agitation produced by said electromagnet, wherein said damping means comprises:

a plurality of substantially parallel pairs of planar members;

said pairs of planar members being spaced apart vertically along the path of said strip and extending across said bath in a direction transverse to the direction of the strip path;

each of said pairs of planar members defining a slot therebetween;

said slots being aligned with the slot defined by each of the other pairs of planar members, to permit the passage of said strip through said slots as the strip moves along its path.

2. A system as recited in claim 1 wherein:

at least some of said planar members are located within said vessel between the downwardly converging vessel side walls and have respective lateral dimensions, in a direction extending between the side walls, which progressively decrease in a downward direction.

3. A system as recited in claim 1 wherein there is a gap between the two opposed, mutually facing pole faces and wherein:

said pairs of planar members are disposed in said gap and between the converging side walls of said vessel;

and at least one pair of said planar members is composed of ferromagnetic material to reduce the effective gap between said pole faces.

4. A system as recited in claim 3 wherein:

said one pair of ferromagnetic planar members is located adjacent said narrow lower part of said vessel.

5. A system as recited in claim 1 wherein:

said narrow lower part of the vessel includes a passage extending downstream from said bottom opening;

said passage being defined by a pair of opposite longitudinal sides and a pair of opposed ends each extending between said sides of the passage;

each end of the passage being spaced from an adjacent end wall of the vessel;

and said vessel comprises a dam at each end of said passage;

each dam extending upwardly at said end of the passage and laterally across the vessel interior between opposed side walls of the vessel.

6. A system as recited in claim 5 wherein said vessel comprises:

a sump at each end of the vessel between a vessel end wall and the adjacent dam.

7. A system as recited in claim 6 wherein:

each of said sumps comprises means for confining a pool of molten metal.

8. A system as recited in claim 1 wherein:

said electromagnet comprises means for generating a magnetic field which extends between said opposed, mutually facing, pole faces;

said system comprises means for providing an electric current having a portion which (i) flows along the bottom of said bath, in the longitudinal direction of said vessel, and (ii) cooperates with said magnetic field generated by said electromagnet to produce a magnetic force which urges said molten metal bath away from said bottom opening;

and said system comprises an electric current conductor defining a low resistance conductive path to be followed by that part of said electric current other than the portion thereof that flows along said bath bottom.

9. A system as recited in claim 8 wherein:

said narrow lower part of the vessel includes a passage extending downstream from said bottom opening;

said passage being defined by a pair of opposed sides and a pair of opposed ends each extending between said sides of the passage;

each end of the passage being spaced from an adjacent end wall of the vessel;

said vessel comprises a bottom wall portion extending between an end of said passage and the adjacent end wall of the vessel;

and said current conductor further comprises means for directing said electric current into the end space between (a) an end of the passage and (b) the adjacent end wall of the vessel.

10. A system as recited in claim 9 wherein:

said electromagnet comprises coil means;

said system comprises means for flowing a time-varying electric current through said coil means to generate said magnetic field;

and said electromagnet comprises means, responsive to the flow of said time-varying current through said coil means, for generating a magnetic field which flows through said molten metal bath between said facing pole faces and in turn generates eddy currents in said bath which include said current portion that flows along the bottom of said bath.

11. A system as recited in claim 10 wherein:

said current conductor comprises means for substantially reducing the flow of eddy currents along the top of said bath.

12. A system as recited in claim 10 wherein:

said current conductor is composed of electrically conductive material;

said current conductor comprises a pair of arms each disposed adjacent a respective end wall of said vessel;

each arm is conductively connected to the other arm; and said current conductor comprises a pair of terminal end portions each connected to a respective arm and each located within a respective end space of said vessel, above said bottom wall portion of the vessel, and in electrical contact with the bath there.

13. A system as recited in claim 12 wherein:

each of said arms includes a portion that is located within said vessel;

and said system comprises means for electrically and thermally insulating said arm portion from said molten metal bath.

14. A system as recited in claim 12 wherein:

both of said arms are located outside of said vessel;

and said current conductor comprises a connecting portion extending from each terminal end portion, through a wall of said vessel, to a respective arm.

15. A system as recited in claim 12 wherein said terminal end portion is composed of copper, said coating metal is zinc and said system comprises:

means for preventing the copper in said terminal end portion from metalurgically combining with the zinc in said bath of molten coating metal.

16. A system as recited in claim 15 wherein said preventing means comprises:

means for chilling said terminal end portion to solidify coating metal around said terminal end portion to protect said terminal end portion against erosion by the molten coating metal in said bath.

17. A system as recited in claim 16 wherein said chilling means comprises:

an internal channel within said terminal end portion;

and means for flowing a cooling fluid through said internal channel.

18. A system as recited in claim 9 wherein:

said electromagnet comprises coil means;

said system comprises means for flowing direct current uninterruptedly through said coil means to generate a magnetic field which flows through said bath between said facing pole faces;

said current conductor comprises a pair of terminal end portions each located within a respective end space of said vessel, above said bottom wall portion of the vessel and in electrical contact with the bath there;

and said system comprises means for connecting each of said terminal end portions to a source of direct current.

19. A system as recited in claim 9 wherein:

said vessel comprises a dam at each end of said passage:

each dam extends upwardly at said end of the passage and laterally across the vessel interior between opposed side walls of the vessel;

said vessel comprises a sump at each end of the vessel between a vessel end wall and the adjacent dam;

said sump comprises means for confining a pool of molten coating metal;

and said current conductor comprises a pair of terminal end portions each located within a respective sump of said vessel, above said bottom wall portion of the vessel, and in electrical contact with the molten metal pool in said sump.

20. A system as recited in claim 1 wherein said mutually facing pole faces urge said steel strip to undergo side to side movement as the strip moves along its path through said vessel, and said system comprises:

means for maintaining said steel strip, moving along said path, substantially centered between said mutually facing pole faces and for restraining side to side movement of the steel strip as it moves through said vessel.

21. A system as recited in claim 20 wherein said steel strip has a pair of opposed edges and wherein:

said narrow lower part of the vessel includes a passage extending downstream from said bottom opening;

said passage being defined by a pair of opposite longitudinal sides and a pair of opposed ends each extending between said sides of the passage;

each end of said passage being spaced from an adjacent end wall of the vessel;

and said means for maintaining said steel strip substantially centered comprises a pair of mutually facing, horizontally disposed notches each located at a respective end of the passage;

each notch comprising means for engaging a respective edge portion of a steel strip moving along said path.

22. A system as recited in claim 1, and comprising:

means, including said electromagnet, for exerting an upward magnetic force on the bottom of said bath;

a coil for each of said pole members of the electromagnet;

a series electrical circuit including said coils;

said series circuit comprising a source of electrical power and capacitor means connected in series with said coils;

said circuit having a fixed capacitance, a fixed resistance and an inductance;

said circuit comprising means enabling said circuit to be operated close to its resonance;

said circuit comprising means, responsive to operation at an inductance slightly greater than the inductance which produces resonance in said circuit, for increasing the current to said coils whenever there is a drop in the level of the bottom of said bath of molten metal, thereby to increase the upward magnetic force on the bottom of said bath.

23. A system as recited in claim 1 wherein said electromagnet surrounds said vessel and comprises:

an outer member composed of magnetic material and comprising a pair of opposed, facing longitudinal side walls each having a pair of opposite ends, and a pair of end walls each extending between corresponding ends of said side walls;

said side walls and said end walls defining a vertically disposed space, having open upper and lower ends, for receiving said vessel;

each of said pole members of the electromagnet being mounted on a respective side wall of said outer member, within said vertically-disposed space;

each of said pole members extending inwardly within said space toward the other pole member and terminating at a respective one of said opposed, mutually facing pole faces;

said pole faces defining a gap therebetween to accommodate said vessel;

and a pair of coils for conducting electric current, each of said coils encompassing a respective one of said pole members;

each coil comprising means, responsive to the flow of electric current through said coil, for generating a magnetic field within the pole member encompassed by said coil.

24. A system as recited in claim 23 wherein said electromagnet comprises:

means, including said pole members and said outer member, for providing a path along which said magnetic field extends from the pole face on one pole member across said gap to the pole face on the other pole member, then sequentially through the other pole member, through the longitudinal side wall on which said other pole member is mounted, through said end walls of the outer member, through said longitudinal side wall on which said one pole member is mounted, and then through said one pole member back to said one pole face.

25. A system as recited in claim 23 wherein:

said electromagnet is composed of two halves each elongated in the direction of elongation of said vessel;

each half having an E-shaped horizontal cross-section.

26. A system as recited in claim 1 wherein:

said vessel is composed of refractory material.

27. A system as recited in claim 1 wherein:

said vessel is composed of non-magnetic stainless steel.

* * * * *